US007926315B2

(12) United States Patent
Poletti

(10) Patent No.: US 7,926,315 B2
(45) Date of Patent: Apr. 19, 2011

(54) LOCK ASSEMBLY WITH ANTI-PANIC FEATURE AND ASSOCIATED METHOD

(75) Inventor: Angelo Poletti, Baveno (IT)

(73) Assignee: Imperial USA, Ltd, Charlotte, NC (US)

( * ) Notice: Subject to any disclaimer, the term of this patent is extended or adjusted under 35 U.S.C. 154(b) by 763 days.

(21) Appl. No.: 11/857,614

(22) Filed: Sep. 19, 2007

(65) Prior Publication Data

US 2008/0066505 A1 Mar. 20, 2008

Related U.S. Application Data

(60) Provisional application No. 60/826,159, filed on Sep. 19, 2006.

(51) Int. Cl.
*E05B 59/00* (2006.01)

(52) U.S. Cl. ..... 70/107; 70/92; 70/451; 70/465; 292/92; 292/336.3

(58) Field of Classification Search ..... 292/92, 292/336.3; 70/92, 107, 222–224, 451, 465
See application file for complete search history.

(56) References Cited

U.S. PATENT DOCUMENTS 2,854,838 A * 10/1958 Foster ..... 70/92
3,672,714 A * 6/1972 Schultz ..... 292/34
3,808,849 A * 5/1974 Alexander ..... 70/149
3,981,164 A 9/1976 Balducci
3,999,789 A * 12/1976 Maurits et al. ..... 292/34
4,006,471 A 2/1977 Pappas
4,011,741 A * 3/1977 Nolin ..... 70/107
4,049,302 A 9/1977 Andersson et al.
4,065,160 A 12/1977 Gilmore, Jr.
4,088,353 A 5/1978 Meyer
4,156,541 A * 5/1979 Babb et al. ..... 292/21
4,183,563 A * 1/1980 Stevens ..... 292/34
4,276,760 A * 7/1981 Nolin ..... 70/107
4,418,552 A * 12/1983 Nolin ..... 70/107
4,809,526 A * 3/1989 Shen ..... 70/107
4,838,053 A * 6/1989 Shen ..... 70/92
4,866,965 A 9/1989 Urdal
5,024,070 A 6/1991 Toledo
5,088,778 A * 2/1992 Lin ..... 292/336.3
5,373,716 A 12/1994 MacNeil et al.
(Continued)

*Primary Examiner* — Suzanne D Barrett
(74) *Attorney, Agent, or Firm* — Alston & Bird LLP

(57) ABSTRACT

An anti-panic lock assembly for a door and associated methods are provided. The lock assembly can be used to secure the door to a keeper structure mounted in a jamb of a door frame so that the assembly can be adjusted by first and second handles extending from the opposite sides of the door. The lock assembly generally includes a latch assembly with a latch member and a deadbolt assembly with a deadbolt member for engaging the keeper structure. The latch member is configured to be adjusted by a rotation of the handles between its extended and retracted positions. The deadbolt member is configured to be adjusted by a rotation of a deadbolt handle and a key lock mechanism between its extended and retracted positions. The assembly can be installed to provide an anti-panic feature from a select side of the door, by using a selective connection feature to selectively link one of the handles to the deadbolt assembly. In a first configuration, the first handle can be configured to adjust the deadbolt assembly to an unlocked configuration while the second handle is locked. In a second configuration, the second handle can be configured to adjust the deadbolt assembly to an unlocked configuration while the first handle is locked.

15 Claims, 39 Drawing Sheets

U.S. PATENT DOCUMENTS 5,496,082 A * 3/1996 Zuckerman ..... 292/336.3
5,513,505 A * 5/1996 Dancs ..... 70/107
5,547,235 A 8/1996 Dziuk et al.
5,561,994 A 10/1996 Smith et al.
5,657,653 A * 8/1997 Hensley et al. ..... 70/224
5,790,034 A 8/1998 Khoury
5,809,812 A * 9/1998 Gallego ..... 70/107
6,053,019 A 4/2000 Wiik et al.
6,058,746 A * 5/2000 Mirshafiee et al. ..... 70/107
6,128,933 A * 10/2000 Mirshafiee et al. ..... 70/107
6,138,485 A * 10/2000 Fuss et al. ..... 70/107
6,170,305 B1 * 1/2001 Shen ..... 70/107
6,302,456 B1 * 10/2001 Errani ..... 292/332
6,536,245 B2 * 3/2003 Chiang ..... 70/107
6,554,329 B1 4/2003 DeBlock et al.
6,609,738 B1 8/2003 Roth et al.
6,729,169 B2 * 5/2004 Moore ..... 70/472
6,899,361 B2 * 5/2005 Dorn ..... 292/332
7,748,759 B2 * 7/2010 Chen et al. ..... 292/347
2001/0028172 A1 * 10/2001 Bates et al. ..... 292/332
2005/0050928 A1 * 3/2005 Frolov et al. ..... 70/278.3
2008/0156049 A1 * 7/2008 Topfer ..... 70/107
2010/0213724 A1 * 8/2010 Uyeda ..... 292/39

* cited by examiner

LOCK ASSEMBLY WITH ANTI-PANIC FEATURE AND ASSOCIATED METHOD

CROSS REFERENCE TO RELATED APPLICATIONS

This application is related to commonly owned copending Provisional Application Ser. No. 60/826,159, filed Sep. 19, 2006, incorporated herein by reference in its entirety, and claims the benefit of its earlier filing date under 35 U.S.C. 119(e).

FIELD OF THE INVENTION

The present invention relates to a lock assembly such as is typically used for securing a door and, more particularly, relates to a lock assembly that can be adapted to provide an anti-panic feature for unlocking the assembly.

BACKGROUND OF THE INVENTION

One conventional lock assembly for use on an exterior swinging door includes a latch and a deadbolt. The latch is configured to be adjusted by a door handle, such as a door knob, and the lock is configured to be adjusted by a lock handle or a key. Both the latch and the deadbolt are adjustable between extended and retracted positions. In the extended position, the latch and deadbolt extend from the door and engage a keeper structure that is mounted at the jamb of the door frame. When the latch and deadbolt are retracted from the keeper structure, the door can be opened. Typically, the latch is biased by a spring to an extended position to engage the keeper structure, and the latch can be retracted by turning a door handle on the interior or exterior sides of the door. The deadbolt is typically not spring-actuated, but instead is adjusted using either a lock handle on the interior side of the door or a key inserted from the exterior side of the door. Such lock assemblies can be used in residential and commercial doors, and the deadbolt and the latch can be provided as part of a single assembly or separate assemblies.

In some cases, it is desirable to provide a single handle for retracting both the latch and the deadbolt. For example, in one conventional lock assembly, an interior handle on the interior side of the door can be rotated to retract the latch and the deadbolt. The deadbolt is extended by rotating a lock handle that is also located on the interior side of the door. Thus, a person can easily open the door from the interior side by rotating a single handle, regardless of whether the door is locked or not. On the exterior side of the assembly, a handle is provided for retracting the latch, and the deadbolt is actuated by inserting a key into a keyhole and rotating the key. Thus, this lock assembly has one side that is to be provided on the interior side of the door and an opposite side that is to be provided on the exterior side of the door. During the installation of the door and/or the lock assembly, the installer identifies the desired orientation and direction of use of the door so that an appropriately configured lock assembly can be installed and then operated as desired to secure the door. The installer may need to choose from multiple lock assemblies to obtain a lock assembly with the desired configuration. In particular, the installer may need to use different locks depending on the orientation and direction of use of the door so that the side of the lock with the interior handle and the lock handle are provided on the interior side of the door. Alternatively, the installer can use a universal lock assembly that is adaptable for use in either configuration; however, such a universal lock assembly typically requires time, effort, and expertise on the part of the installer to adapt the lock assembly as necessary. Thus, the planning and installation of the door and lock assembly can be time-consuming and expensive.

Thus, there exists a need for an improved lock assembly that can facilitate a simplified installation. The lock assembly should also provide a secure locking feature. Preferably, the lock assembly should be adaptable for use with at least swinging doors.

SUMMARY OF THE INVENTION

The present invention generally provides an anti-panic lock assembly for securing a door to a keeper structure that is mounted in a jamb of a door frame of the door such that the lock assembly can be adjusted by a first handle extending from a first side of the door and a second handle extending from a second side of the door opposite the first side.

The lock assembly includes adjustable latch and deadbolt assemblies. The latch assembly has a latch member that is configured to be adjusted by a rotation of the handles between an extended position and a retracted position to thereby selectively engage the keeper structure. The deadbolt assembly has a deadbolt member that is configured to be adjusted by a rotation of a deadbolt handle and a key lock mechanism between an extended position and a retracted position to thereby selectively engage the keeper structure. In addition, the lock assembly provides an anti-panic feature from a select side of the door. For example, a selective connection feature can be configured to be selectively installed in first and second configurations to thereby selectively link the first or second handles to the deadbolt assembly. In the first configuration, the first handle is configured to adjust the deadbolt assembly to an unlocked configuration while the second handle is locked, i.e., prevented from rotating. In the second configuration, the second handle is configured to adjust the deadbolt assembly to an unlocked configuration while the first handle is locked. Thus, the anti-panic feature of the lock assembly can facilitate the unlocking of the door from one side thereof and, further, the anti-panic feature can be provided at either side of the door, e.g., to accommodate different types of installations having different door configurations.

According to one embodiment of the present invention, the lock assembly includes a housing that is configured to be disposed in the door. First and second plates are rotatable mounted in the housing. Each of the plates is configured to be connected to a respective one of the handles so that the plates are configured to rotate about an axis that is defined by the handles. A latch link is configured to rotate about the axis, and the latch link has a flange that extends from the plates and defines a connection portion. The latch member is adjustably mounted in the housing and connected to the connection portion of the latch link so that the latch member is configured to be adjusted by a rotation of the latch link between an extended position and a retracted position to thereby selectively engage the keeper structure. A lock link is configured to rotate about the axis, the lock link having a flange extending from the plates and defining a driving feature. The deadbolt member of the deadbolt assembly is also mounted in the housing and configured to be adjusted between an extended position and a retracted position to thereby selectively engage the keeper structure. The deadbolt assembly additionally includes a link member and a driver member. The link member is slidably mounted in the housing and defines first and second connection features, the first connection feature structured to engage a key lock mechanism such that the link member is configured to be slidably adjusted by the key lock mechanism. The driver member is rotatably mounted in the housing and connected to the second connection feature of the link member and to the deadbolt member such that the driver member configured to be rotated by the link member and thereby adjust the deadbolt member between the extended and retracted positions. For example, the driving feature of the flange of the lock link can be configured to contact the driver member and rotate the driver member when the lock link is rotated so that a rotation of the lock link adjusts the deadbolt member to a retracted position.

Each of the plates and the lock link define a selective connection feature for selectively connecting each of the plates to the lock link to thereby configure the lock assembly in first and second configurations. The first plate is connected to the lock link in the first configuration so that a rotation of the first handle rotates the lock link with the driving feature of the lock link in contact with the deadbolt assembly to adjust the deadbolt assembly to an unlocked configuration. The second plate is connected to the lock link in the second configuration so that a rotation of the second handle rotates the lock link with the driving feature of the lock link in contact with the deadbolt assembly to adjust the deadbolt assembly to an unlocked configuration.

For example, each of the plates and the lock link can define an aperture for receiving a lock screw, and the lock screw can be configured to selectively connect a respective one of the plates to the lock link so that the lock link is configured to rotate with the respective plate and the lock link does not rotate with the other plate. In addition, the housing and the lock link can define another pair of corresponding apertures for receiving the lock screw so that the lock screw can be removed from the plates and disposed through the pair of corresponding apertures to fix the lock link to the housing in a third configuration to thereby prevent a rotation of the lock link relative to the housing.

In some cases, a catch member can be adjustably mounted in the housing and configured to engage the deadbolt assembly with the latch assembly when the deadbolt assembly is adjusted to a locked configuration to prevent a rotation of the latch link by at least one of the plates and thereby prevent a retraction of the latch member.

According to one aspect of the invention, a retainer member is configured to slide against the housing in a direction perpendicular to a motion of the deadbolt member. The retainer member can be biased toward the driver member by a deadbolt spring. Further, the retainer member can define a contoured cam profile that is configured to contact a cam shape of the driver member to guide the motion of the driver member. The retainer member and the driver member can also define corresponding flats so that the retainer member is biased to at least one position. The deadbolt member can define a shoulder that has a contoured profile for engaging the contoured cam profile defined by the retainer member so that the contoured cam profile of the retainer member guides a motion of the shoulder and the deadbolt member as the deadbolt member is adjusted between the retracted and extended positions.

According to another embodiment, the present invention can provide a method of providing an anti-panic lock assembly. In one such method, the latch assembly and the deadbolt assemblies are provided, each having the latch and deadbolt members, respectively. A selective connection feature can be selectively installed in one of first and second configurations to thereby selectively link one of the first and second handles to the deadbolt assembly, wherein in the first configuration the first handle is configured to adjust the deadbolt assembly to an unlocked configuration while the second handle is locked, and in the second configuration the second handle is configured to adjust the deadbolt assembly to an unlocked configuration while the first handle is locked, such that the lock assembly is configured to be installed to provide an anti-panic feature from a select side of the door.

BRIEF DESCRIPTION OF THE DRAWINGS

Figure 2:
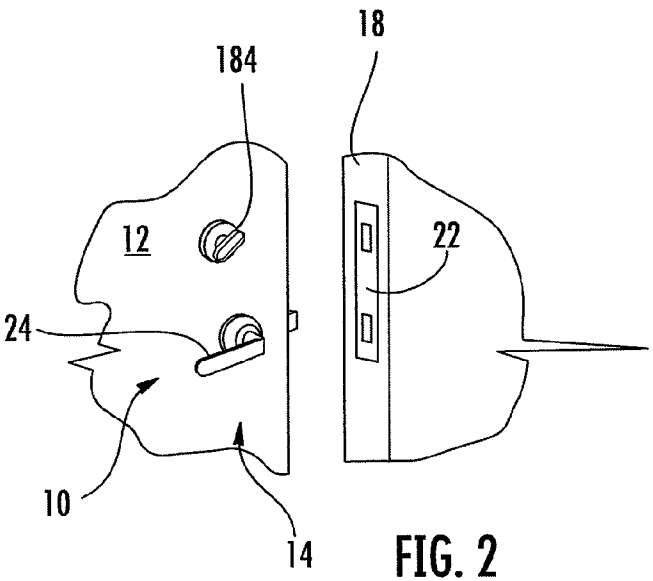
Figure 1:
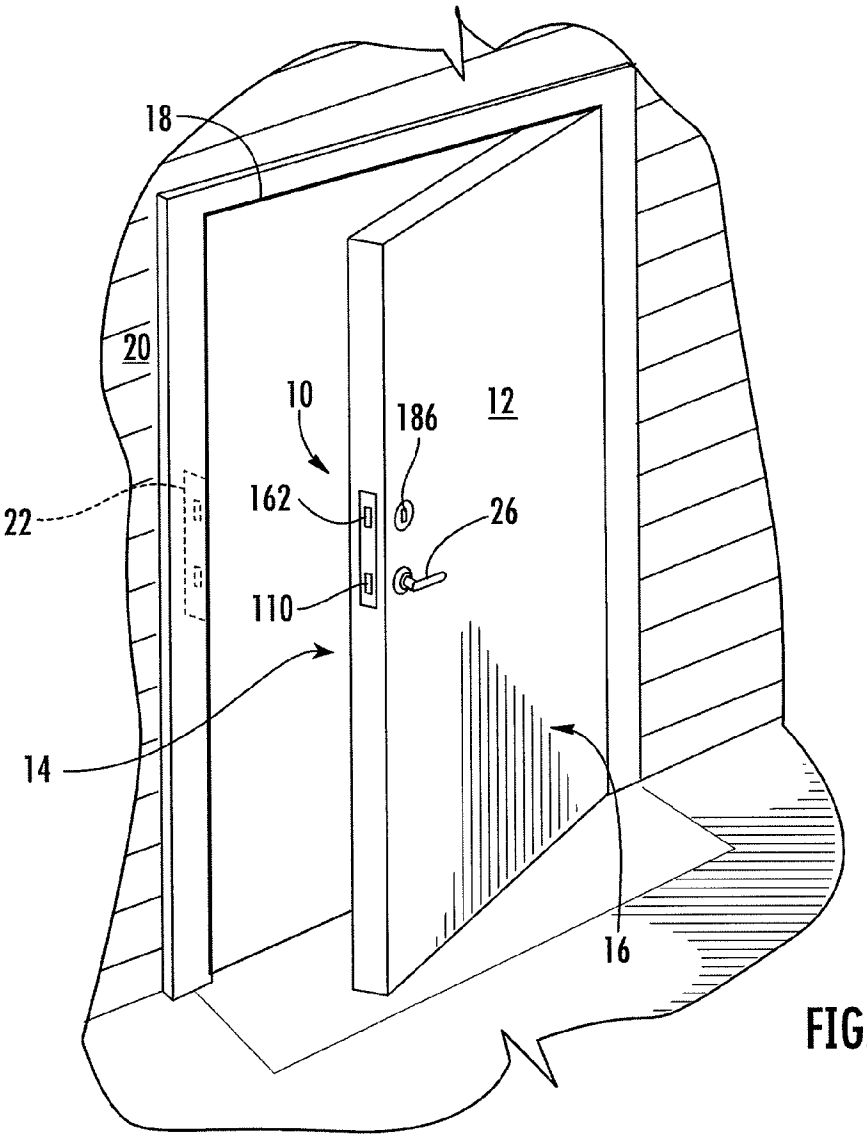
Figure 3:
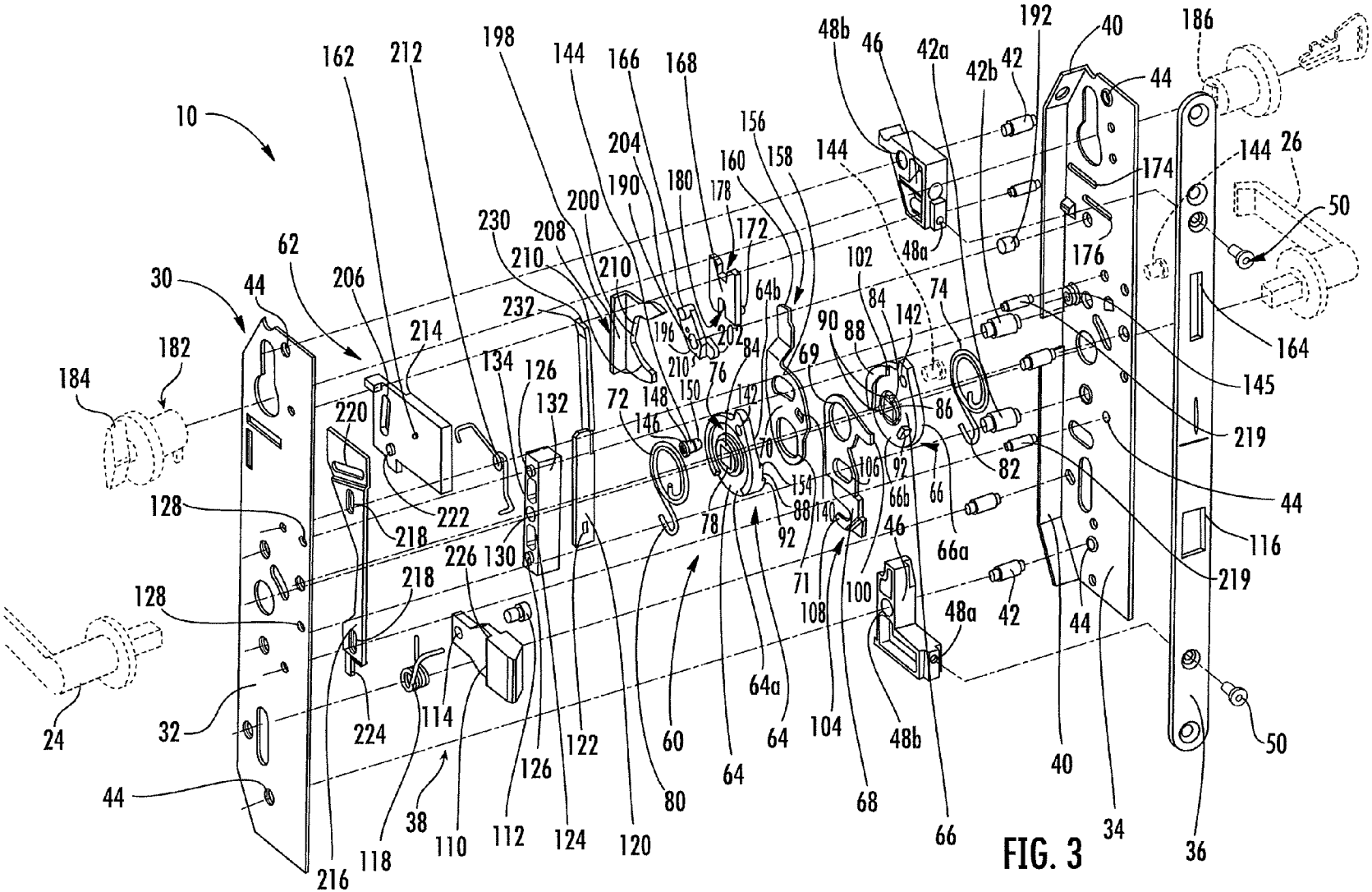
Figure 4:
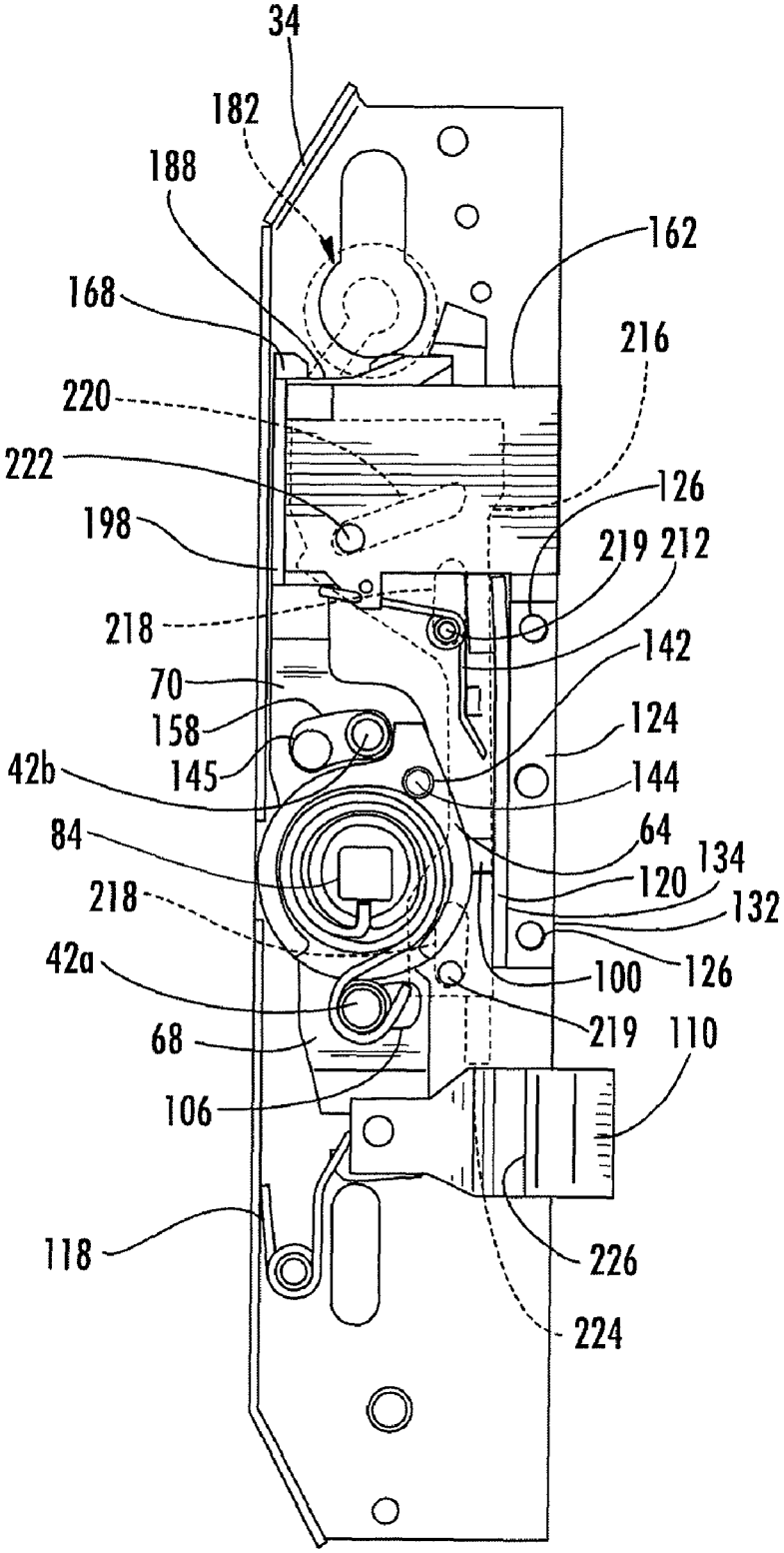
Figure 5:
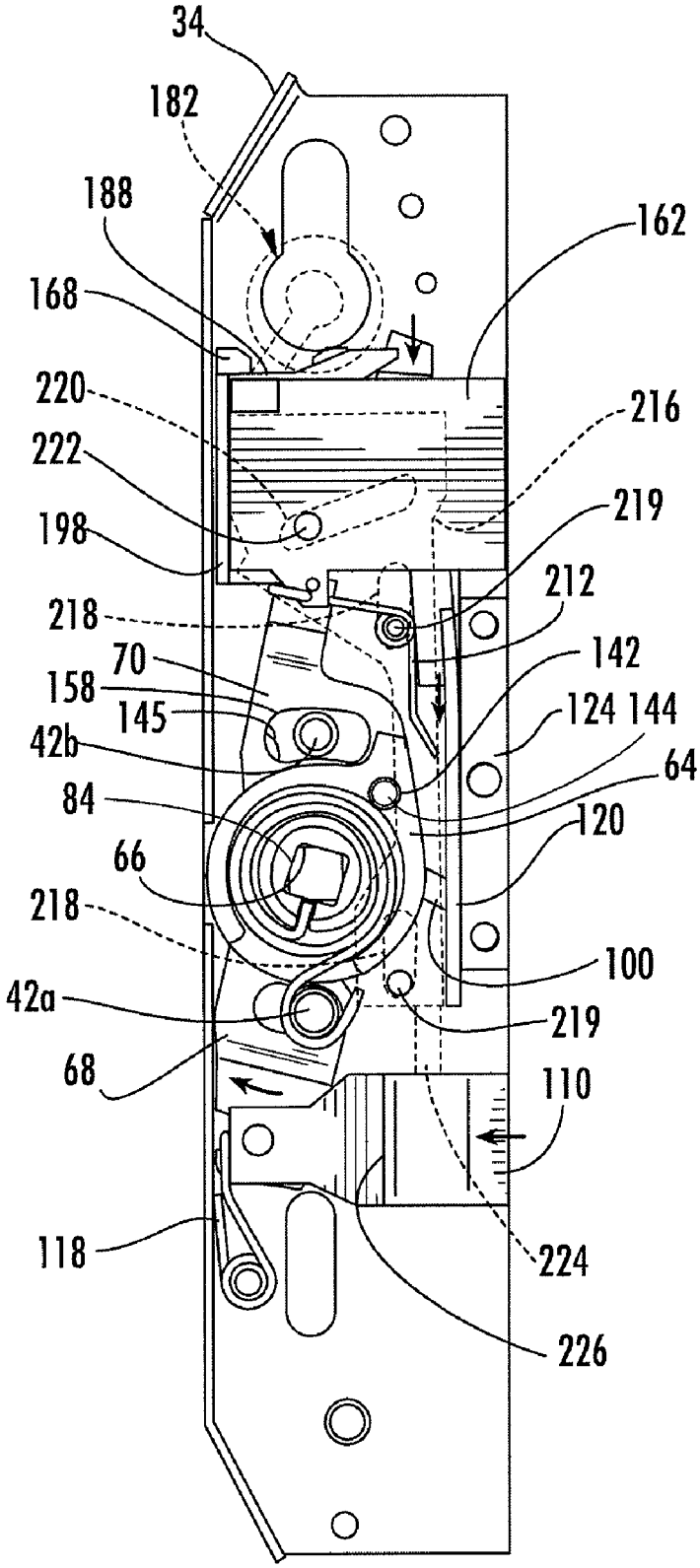
Figure 6:
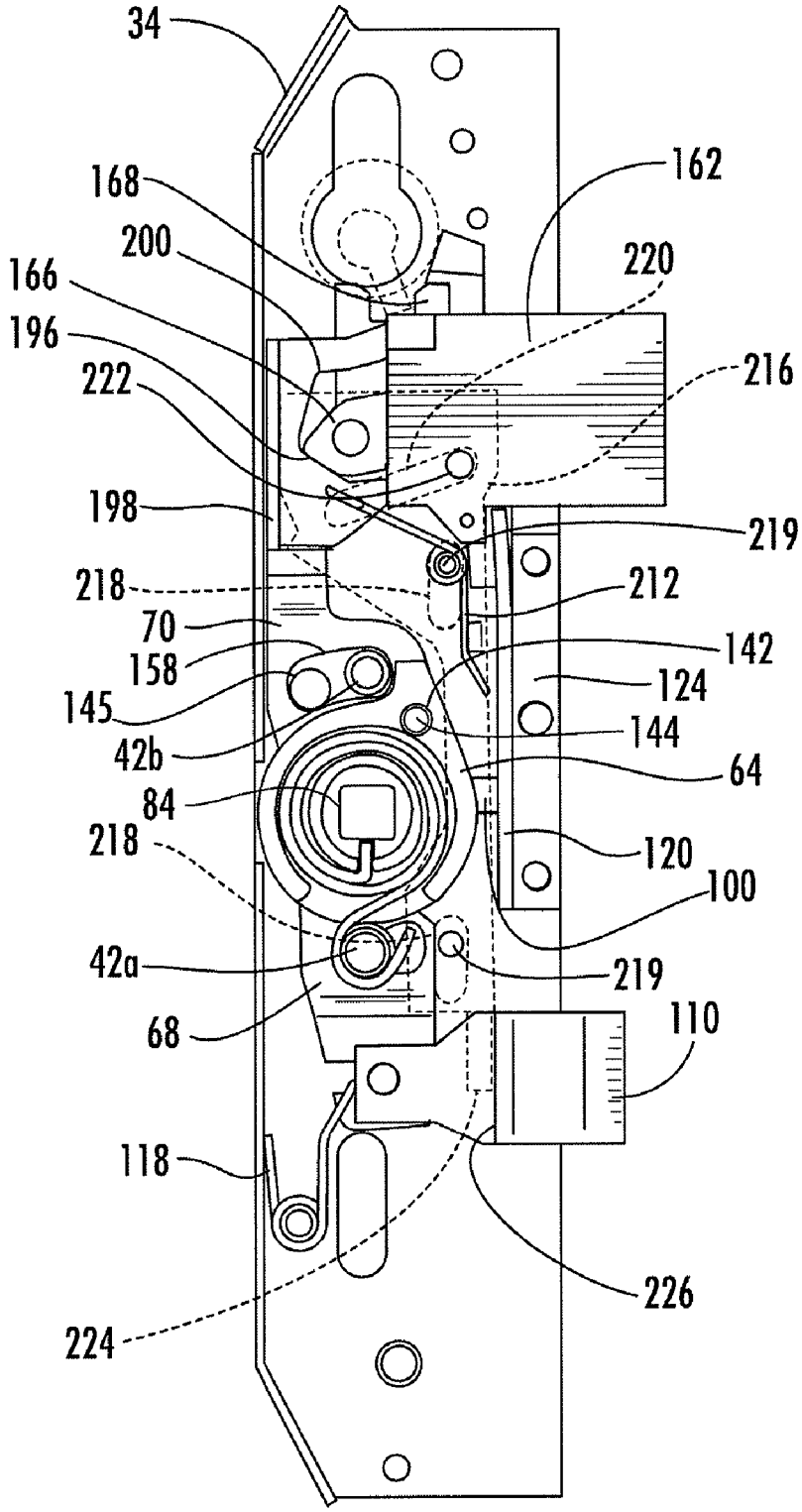
Figure 7:
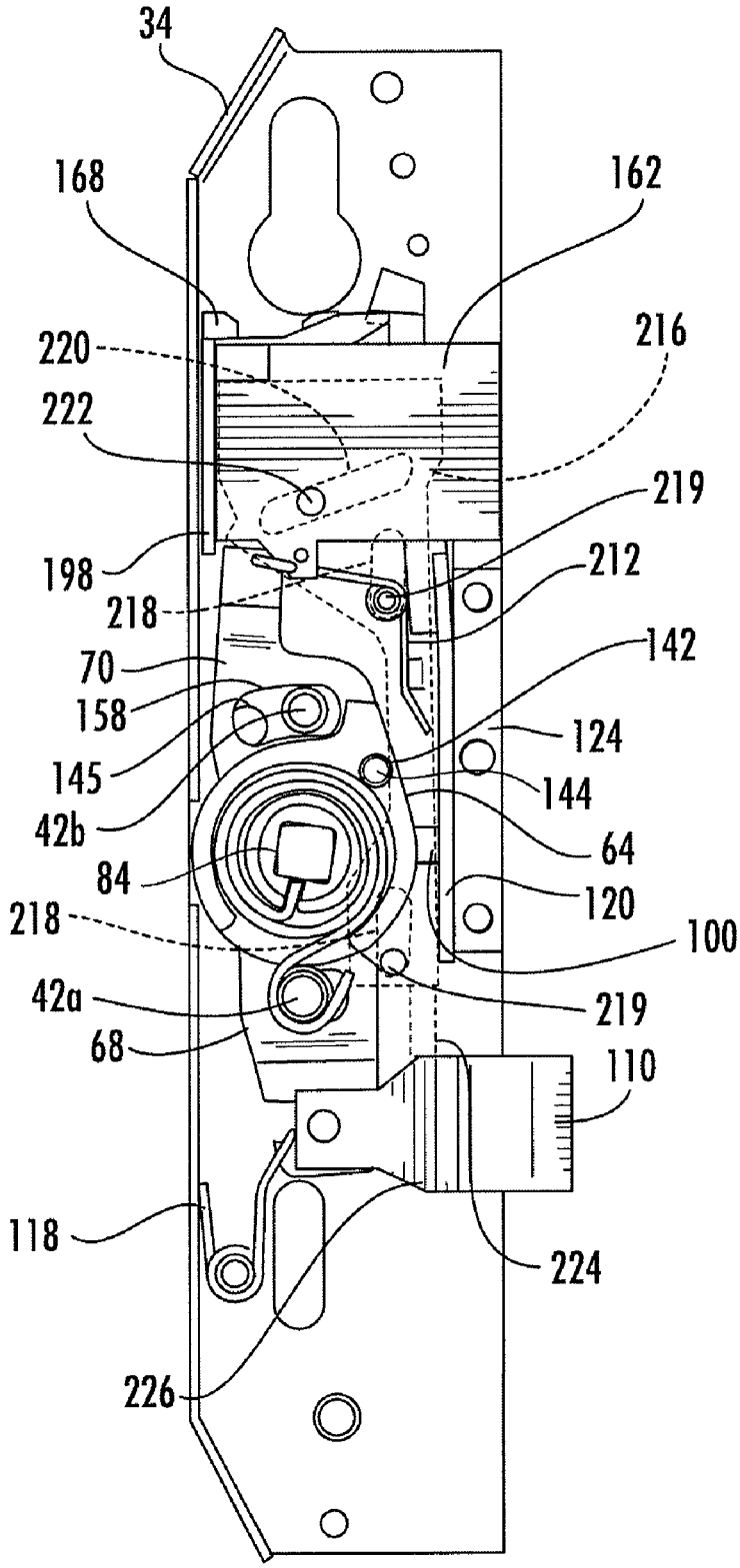
Figure 8:
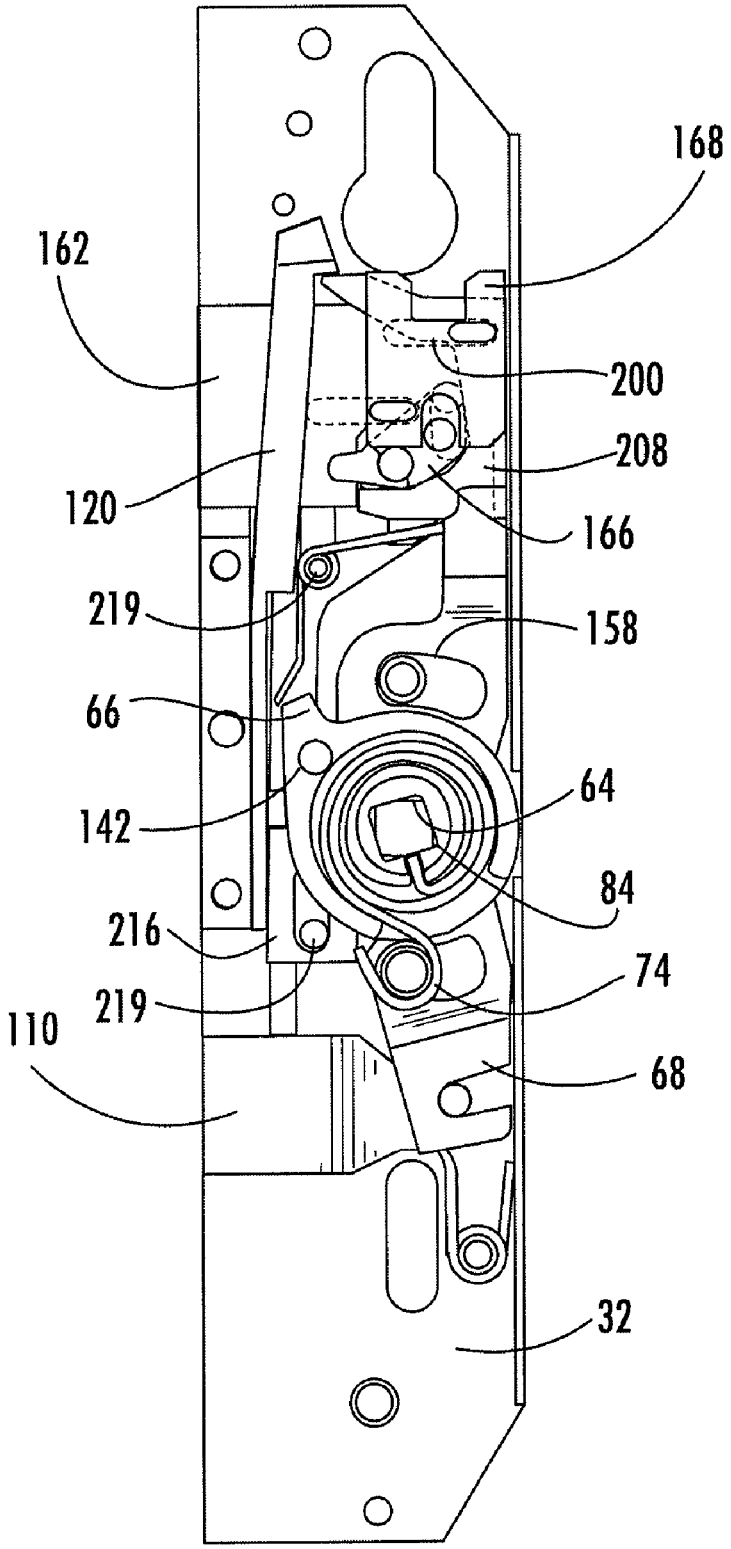
Figure 9:
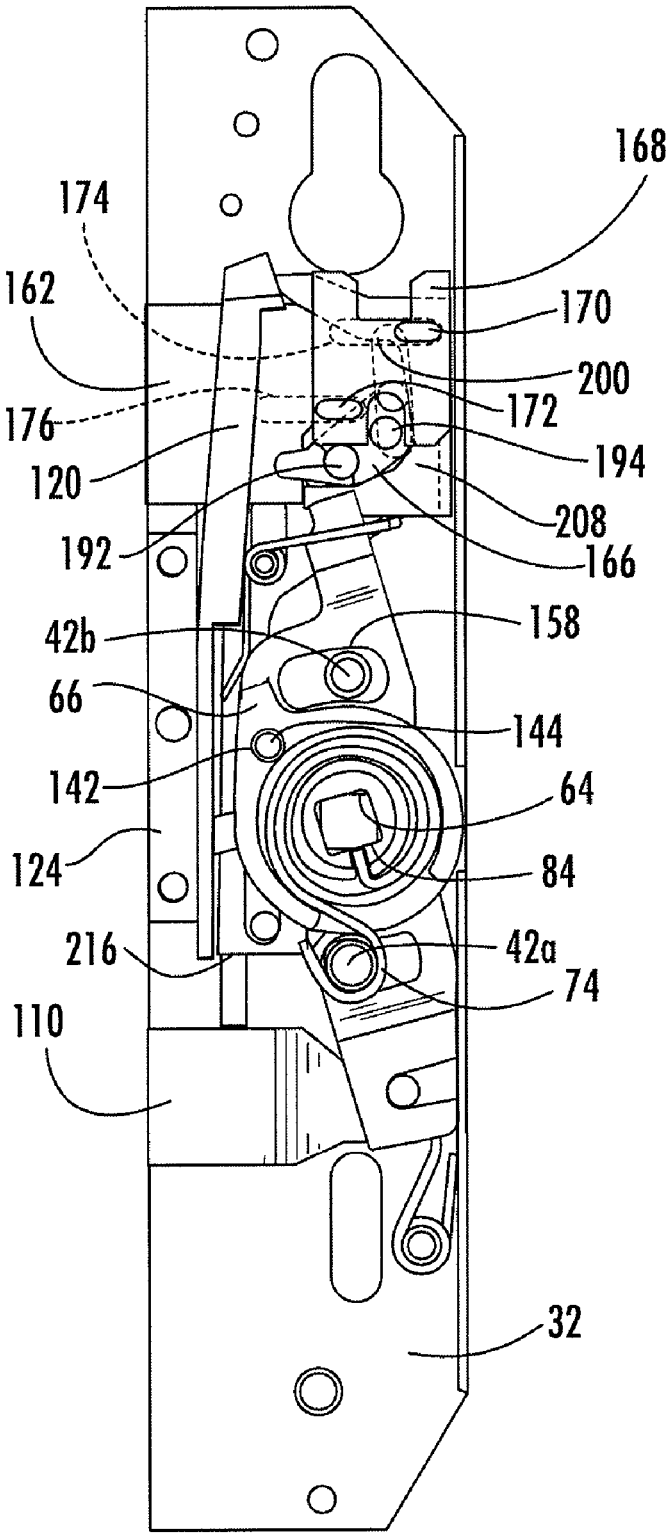
Figure 10:
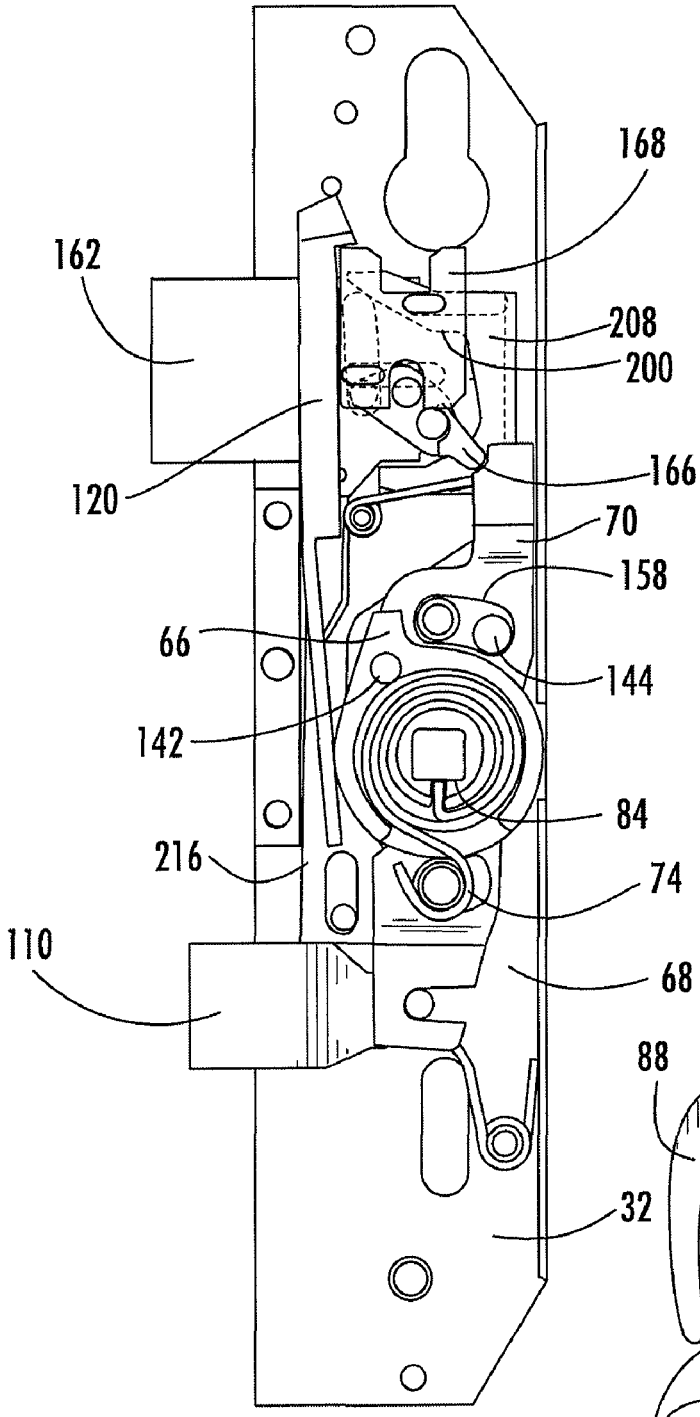
Figure 11:
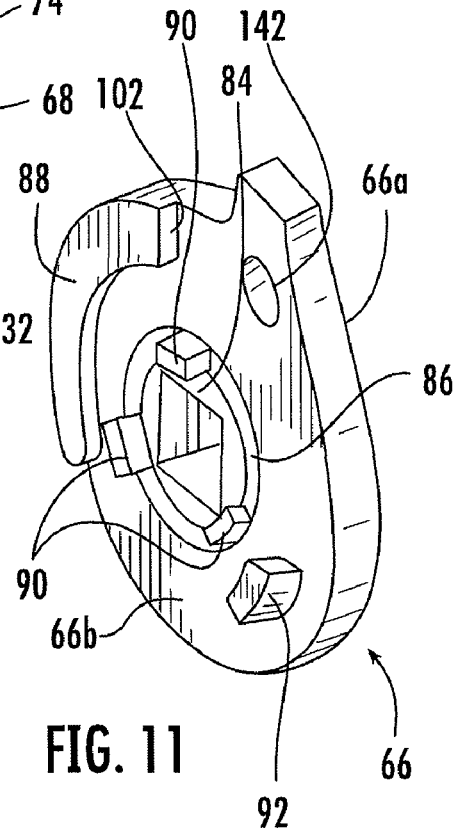
Figure 12:
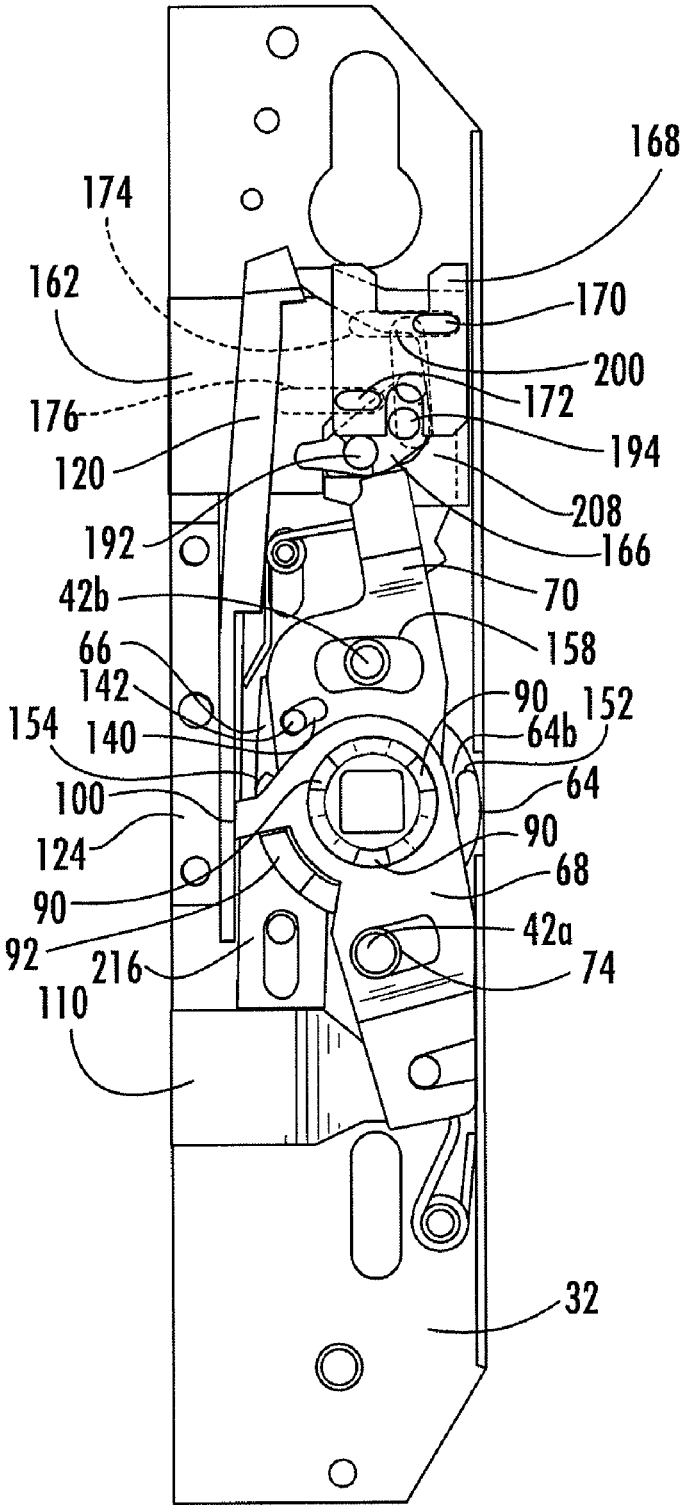
Figure 13:
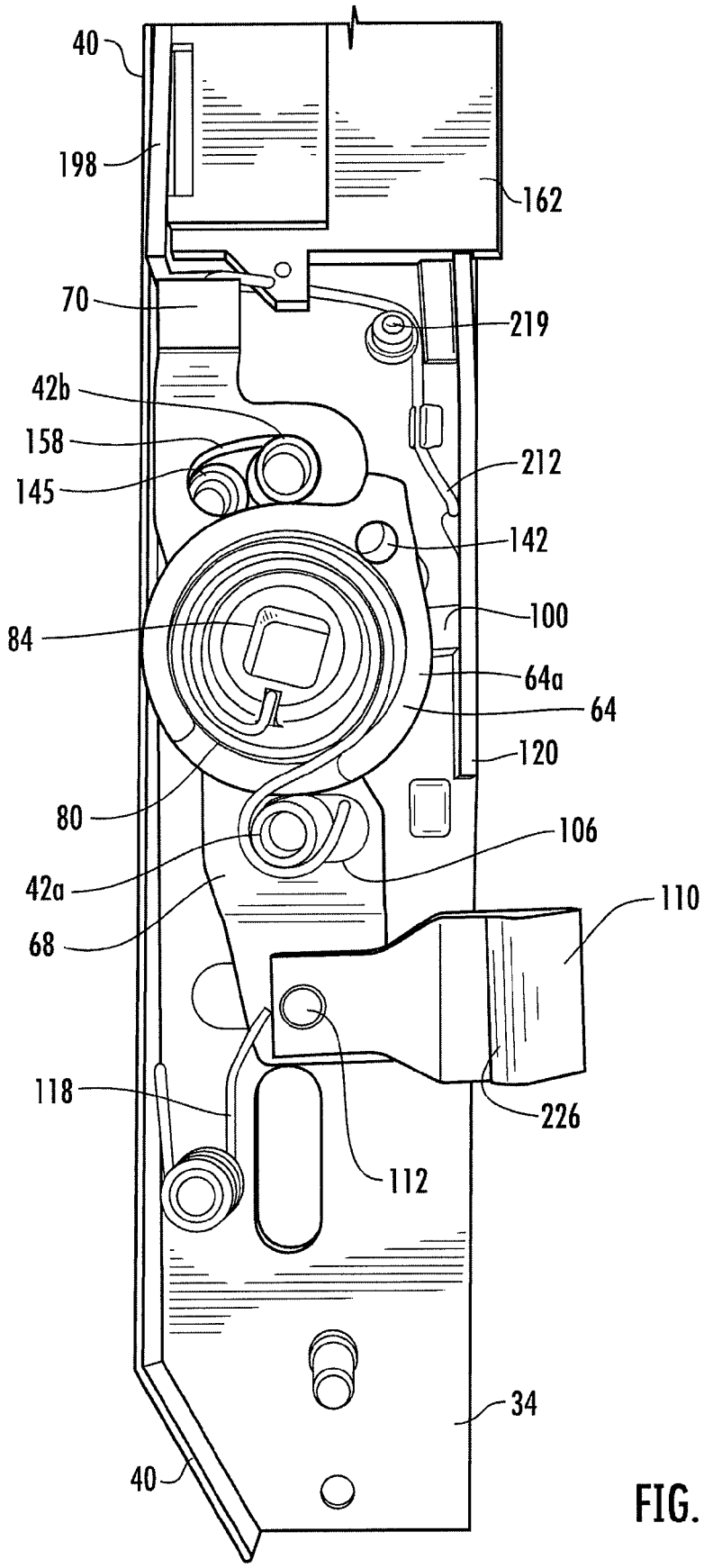
Figure 14:
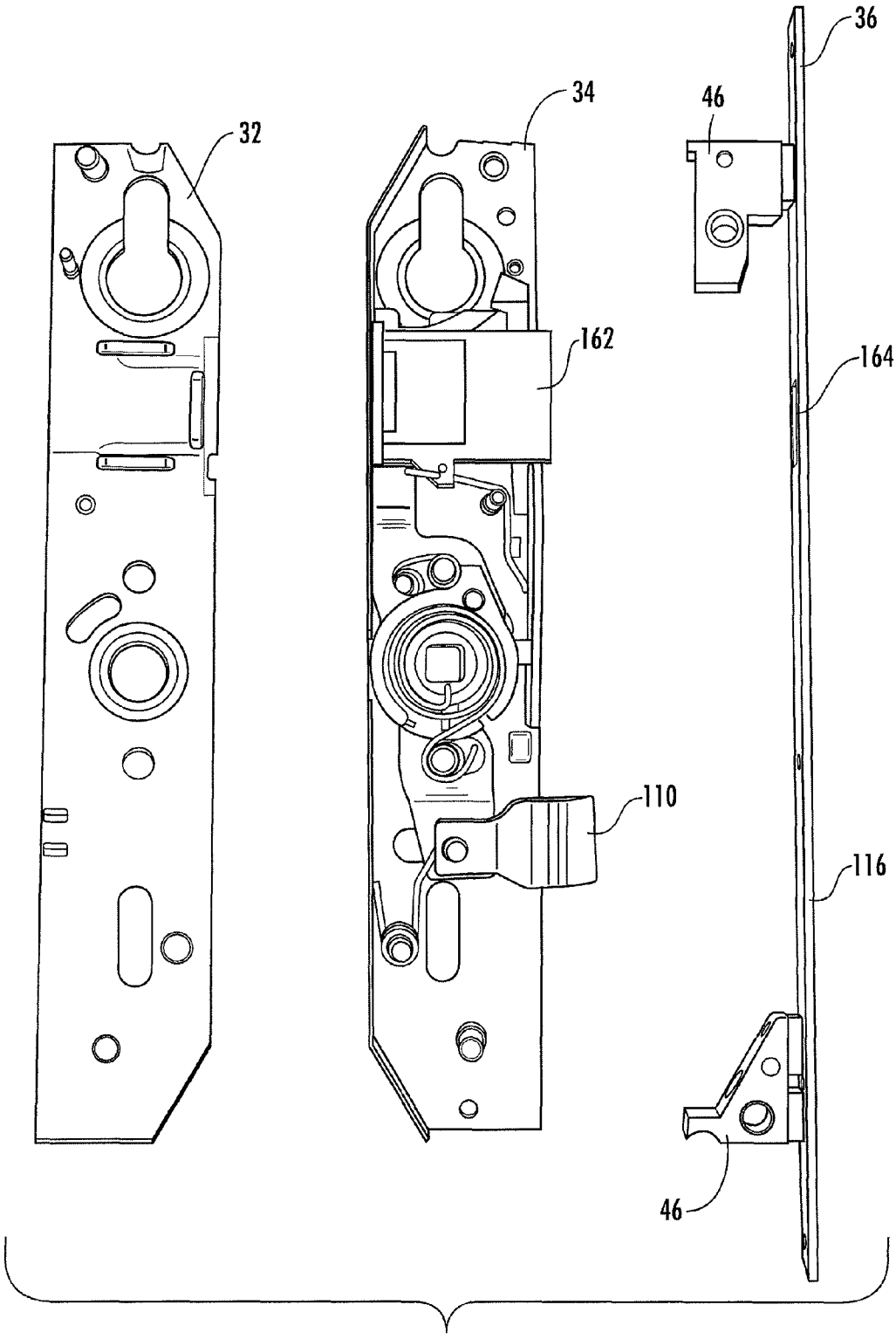
Figure 15:
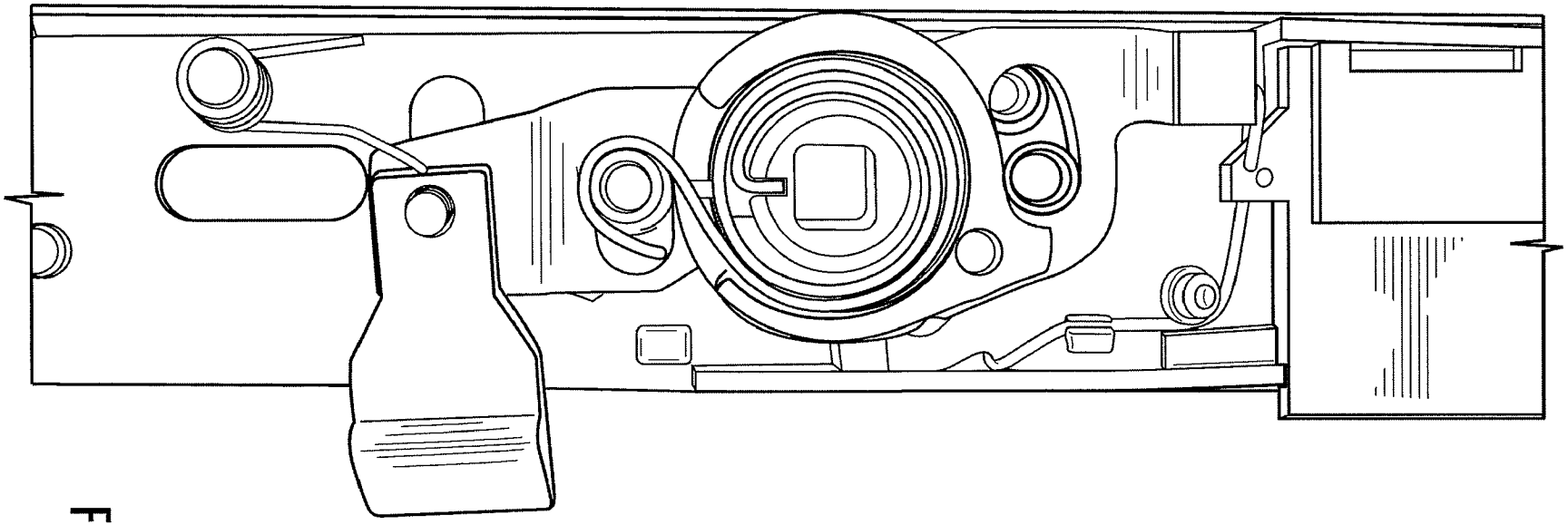
Figure 16:
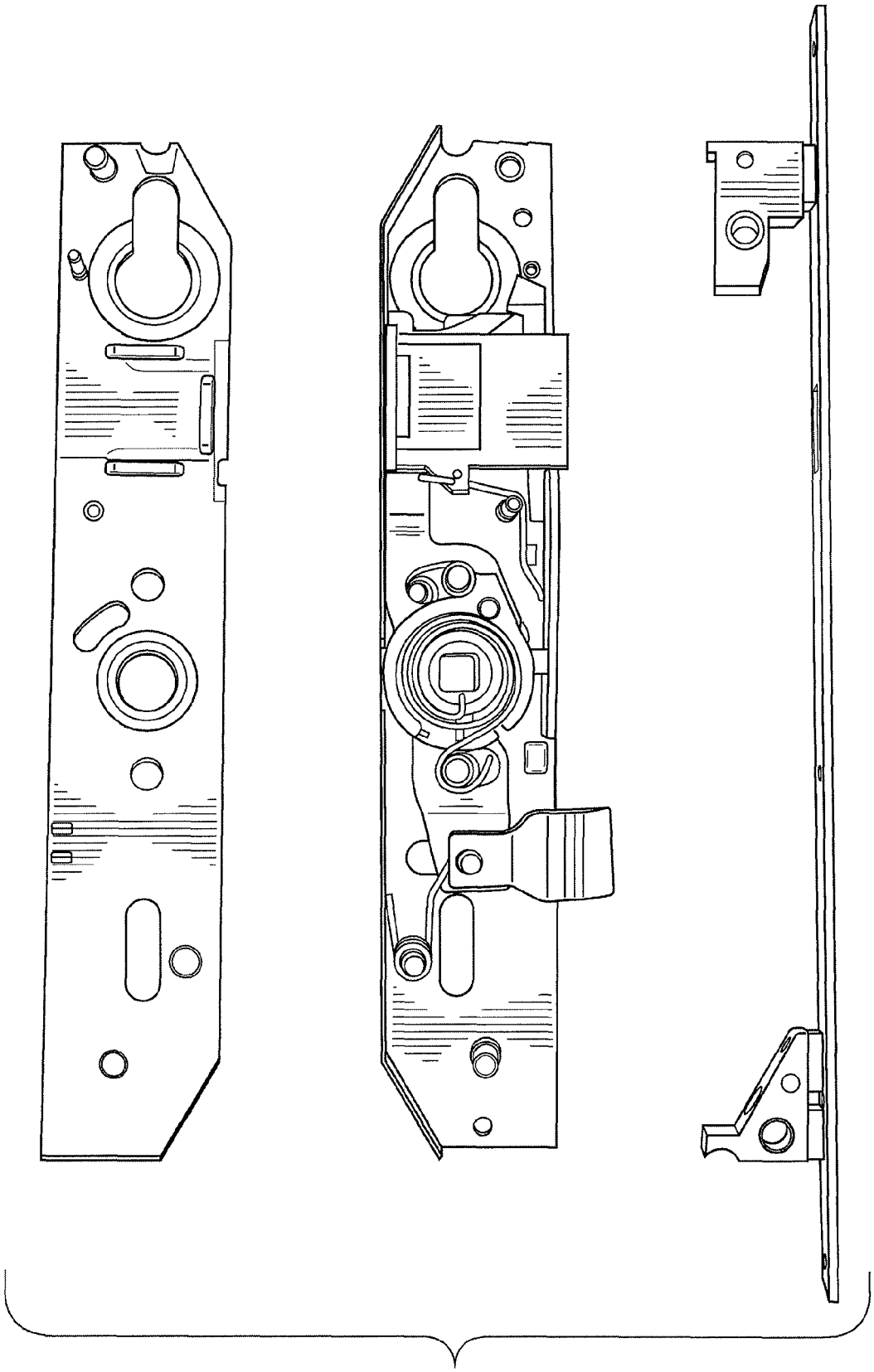
Figure 17:
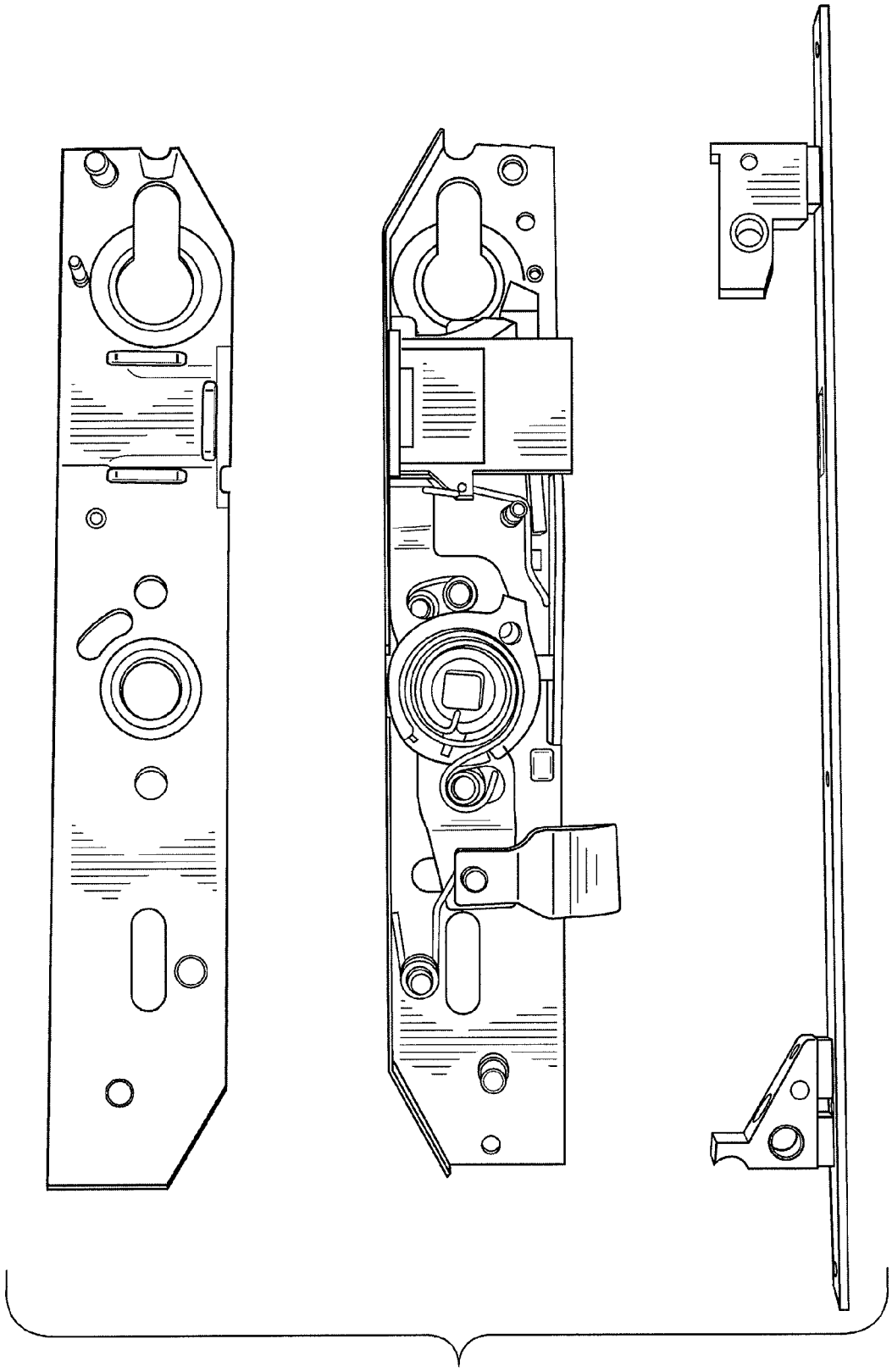
Figure 18:
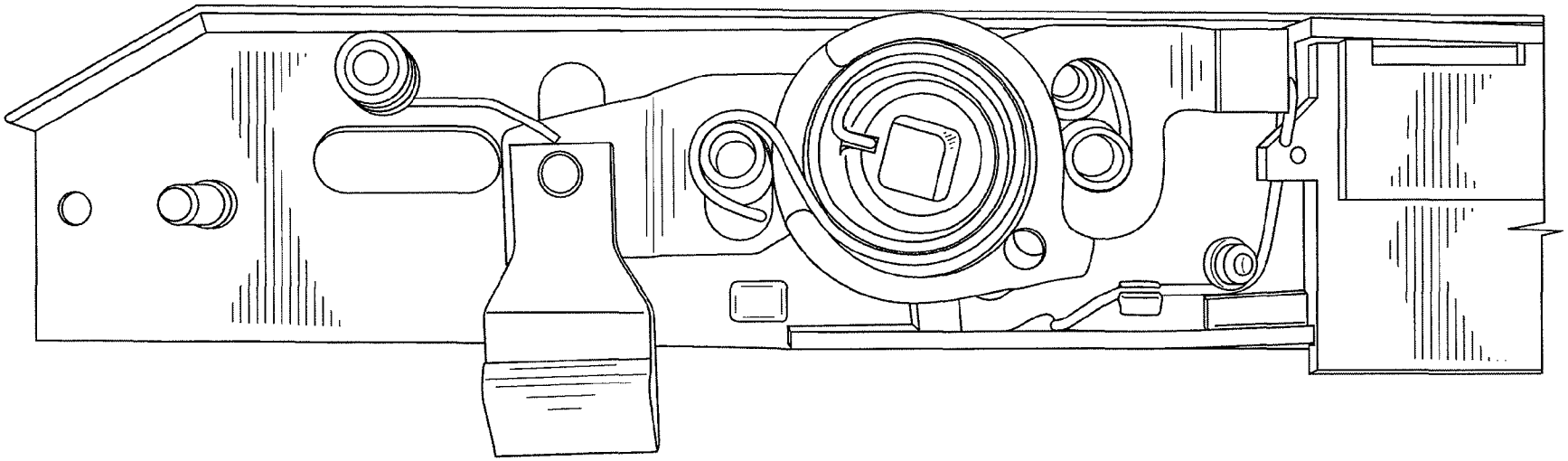
Figure 19:
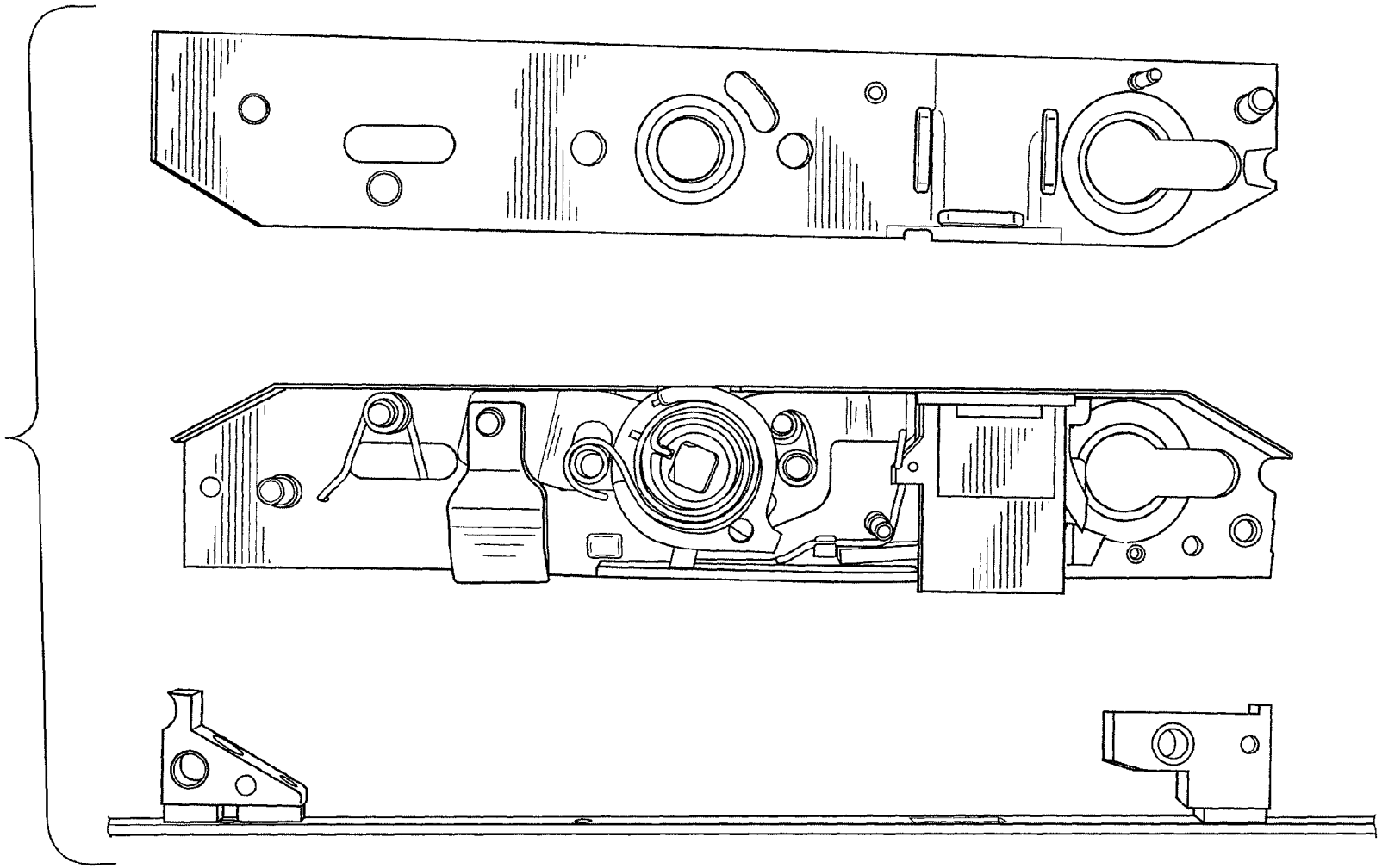
Figure 20:
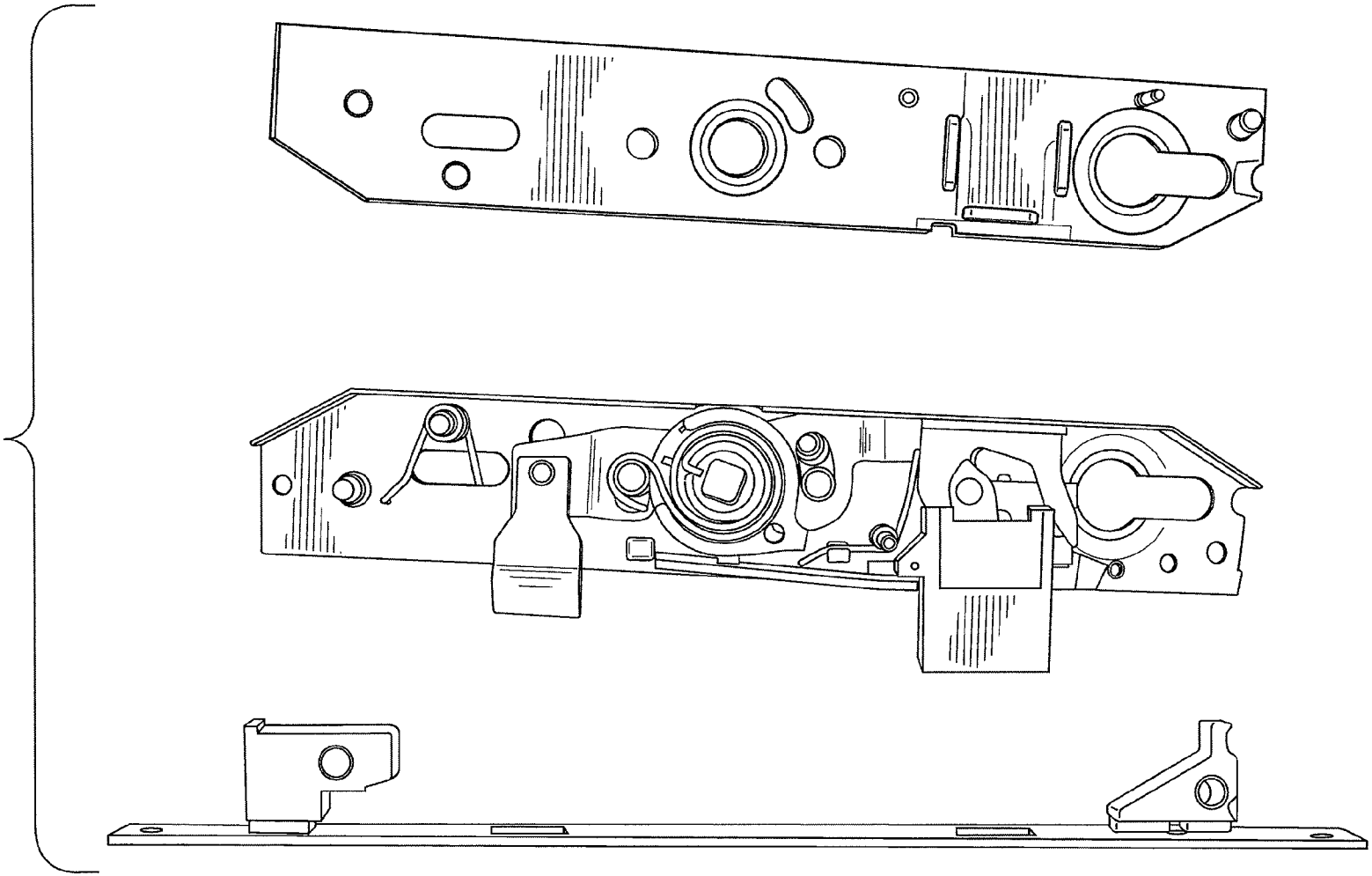
Figure 21:
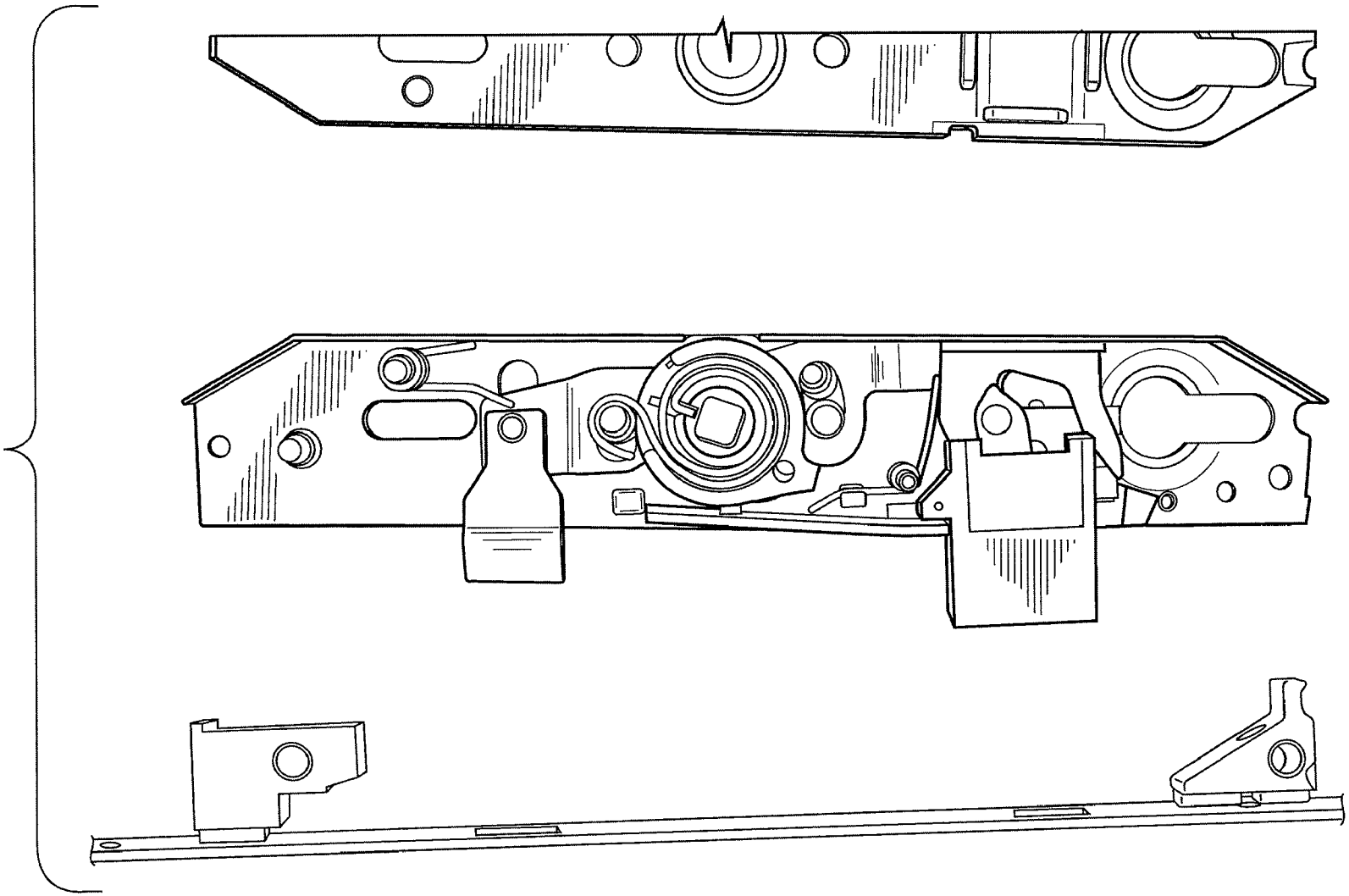
Figure 22:
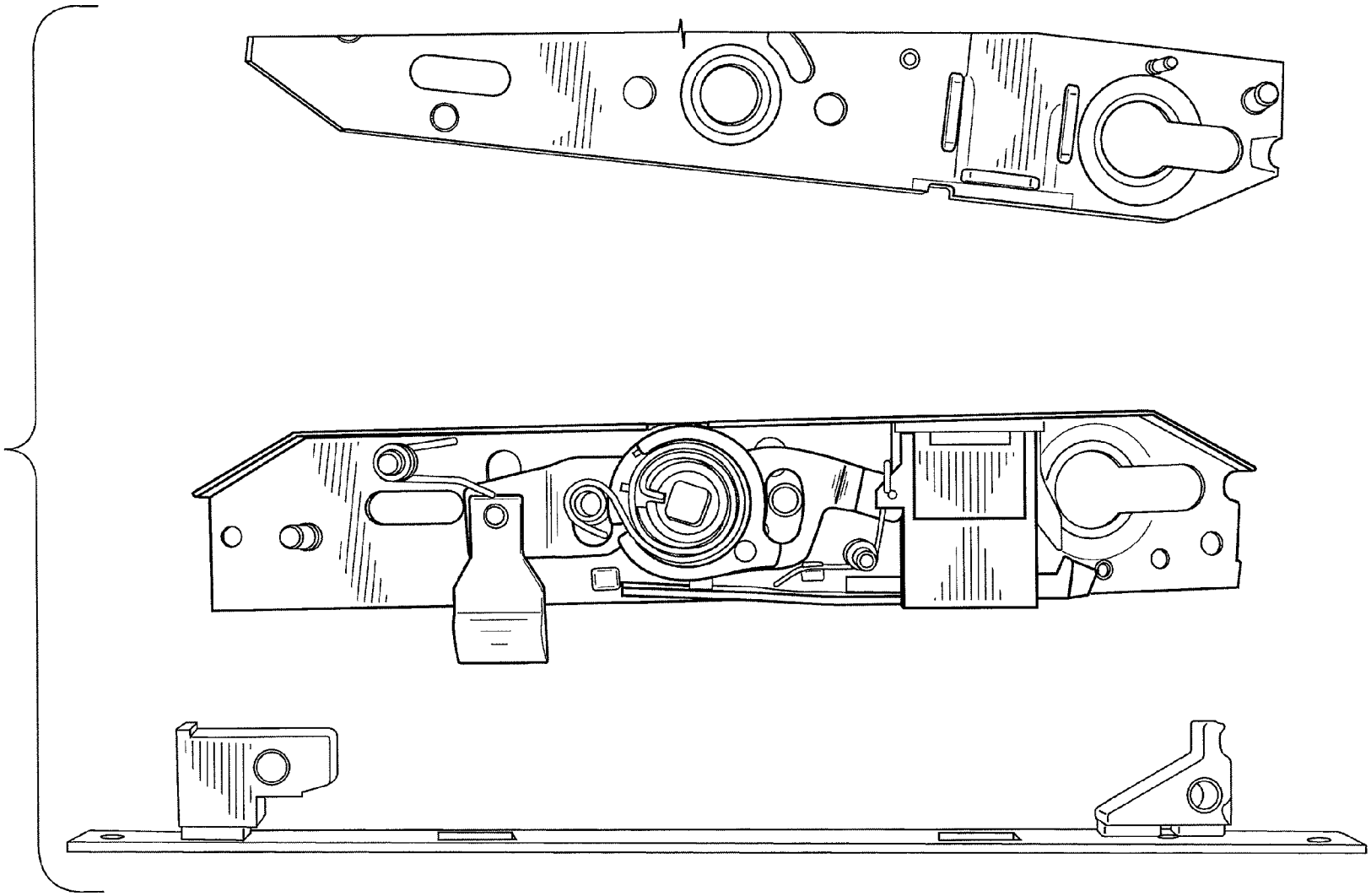
Figure 23:
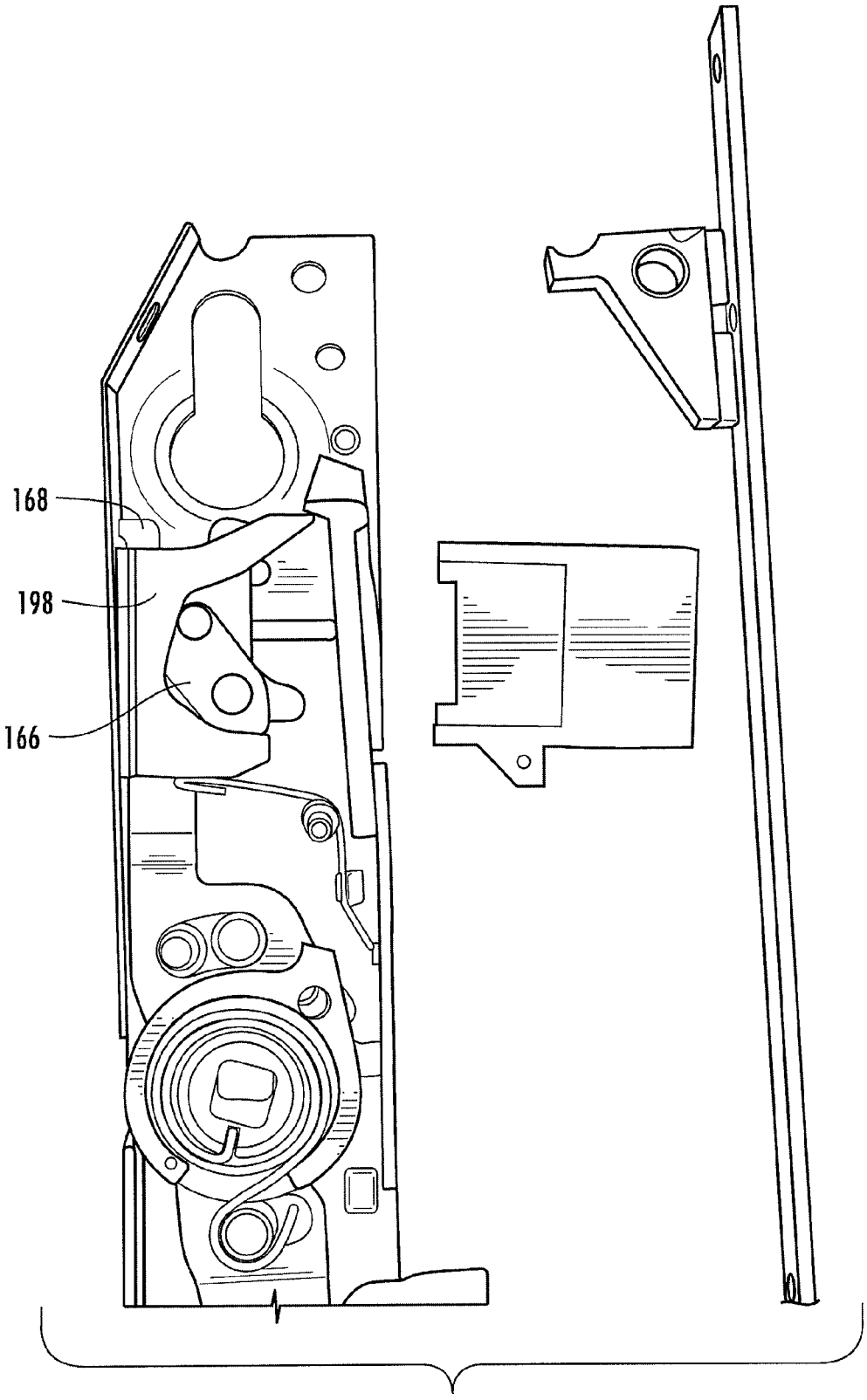
Figure 24:
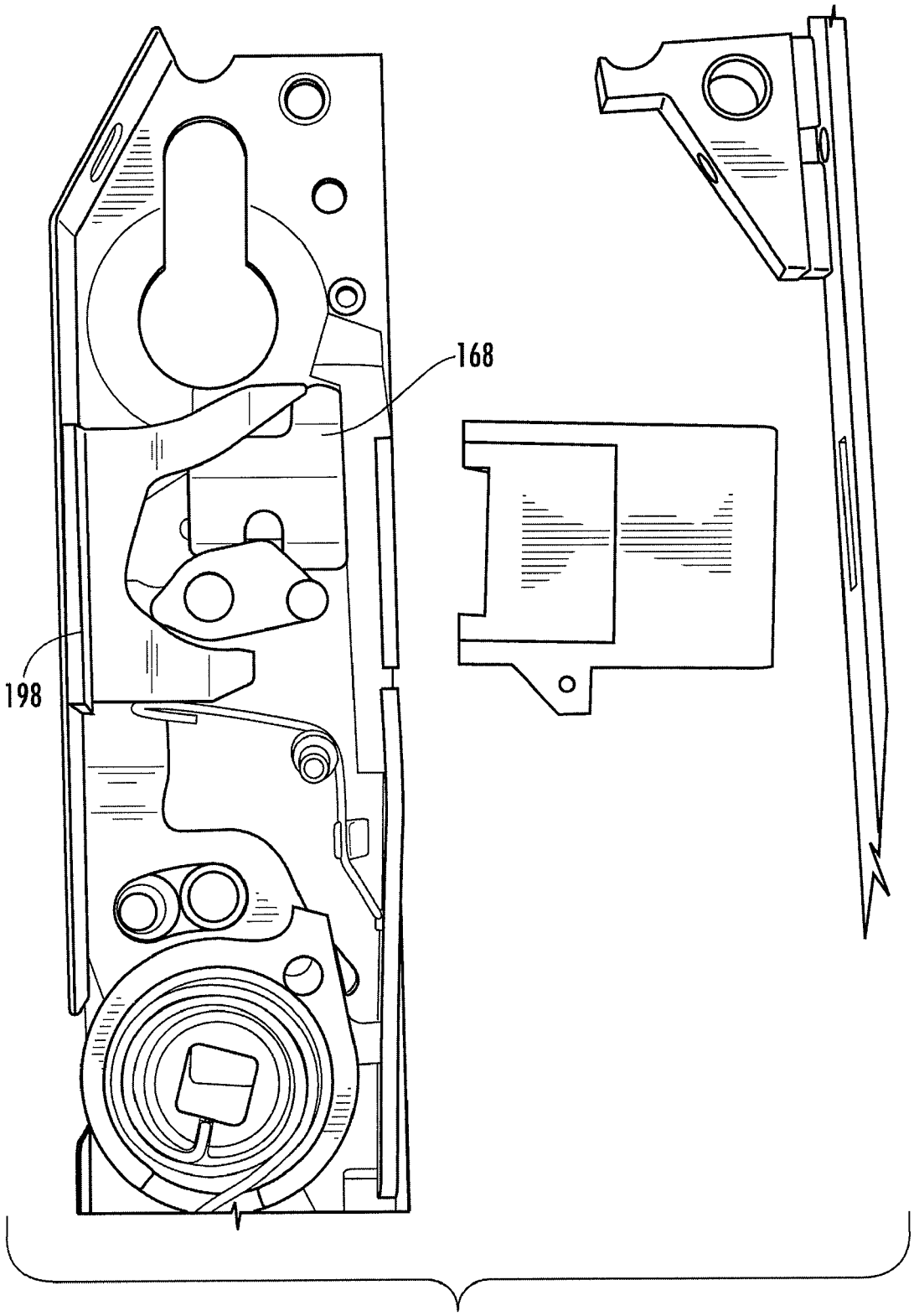
Figure 25:
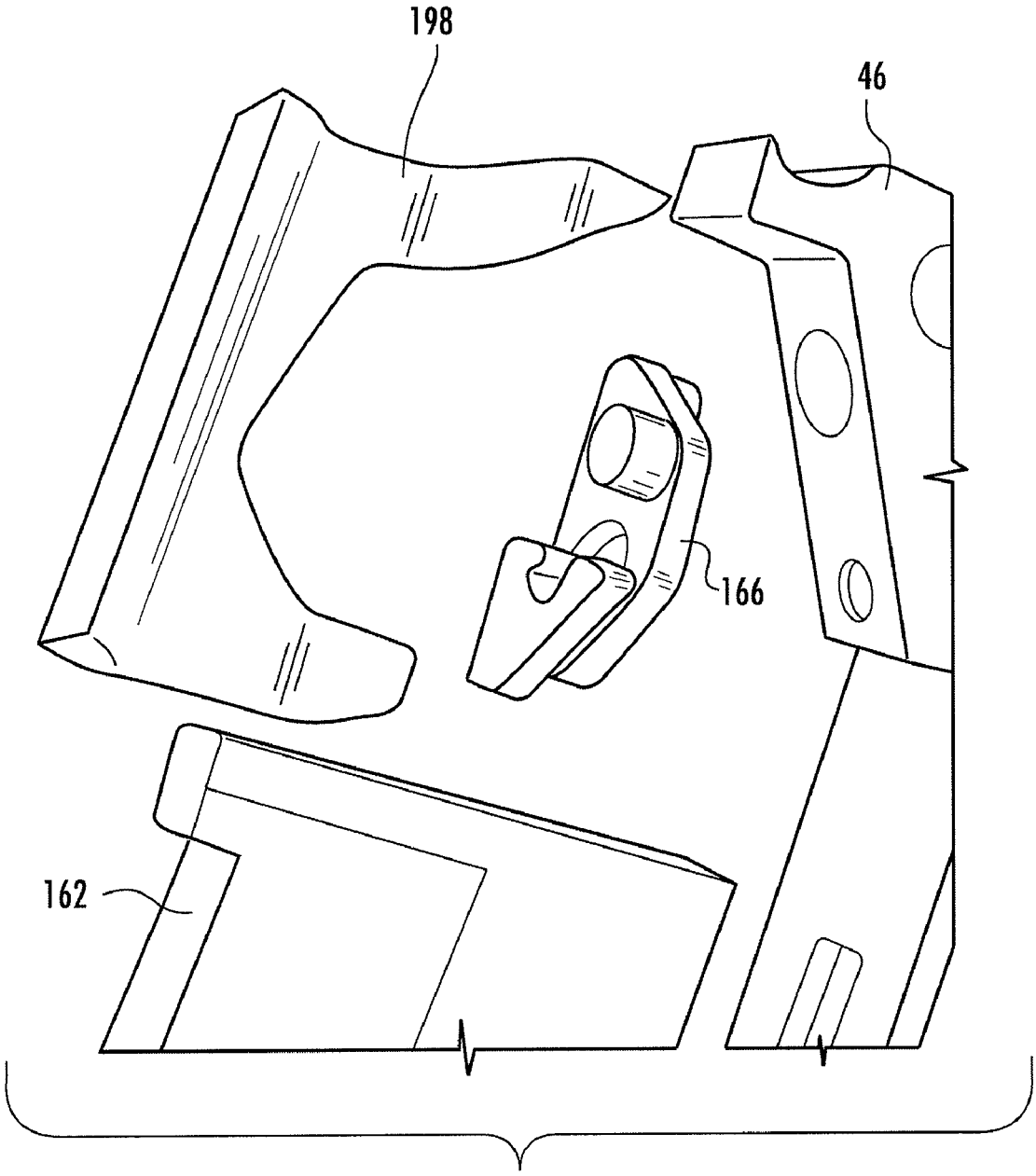
Figure 26:
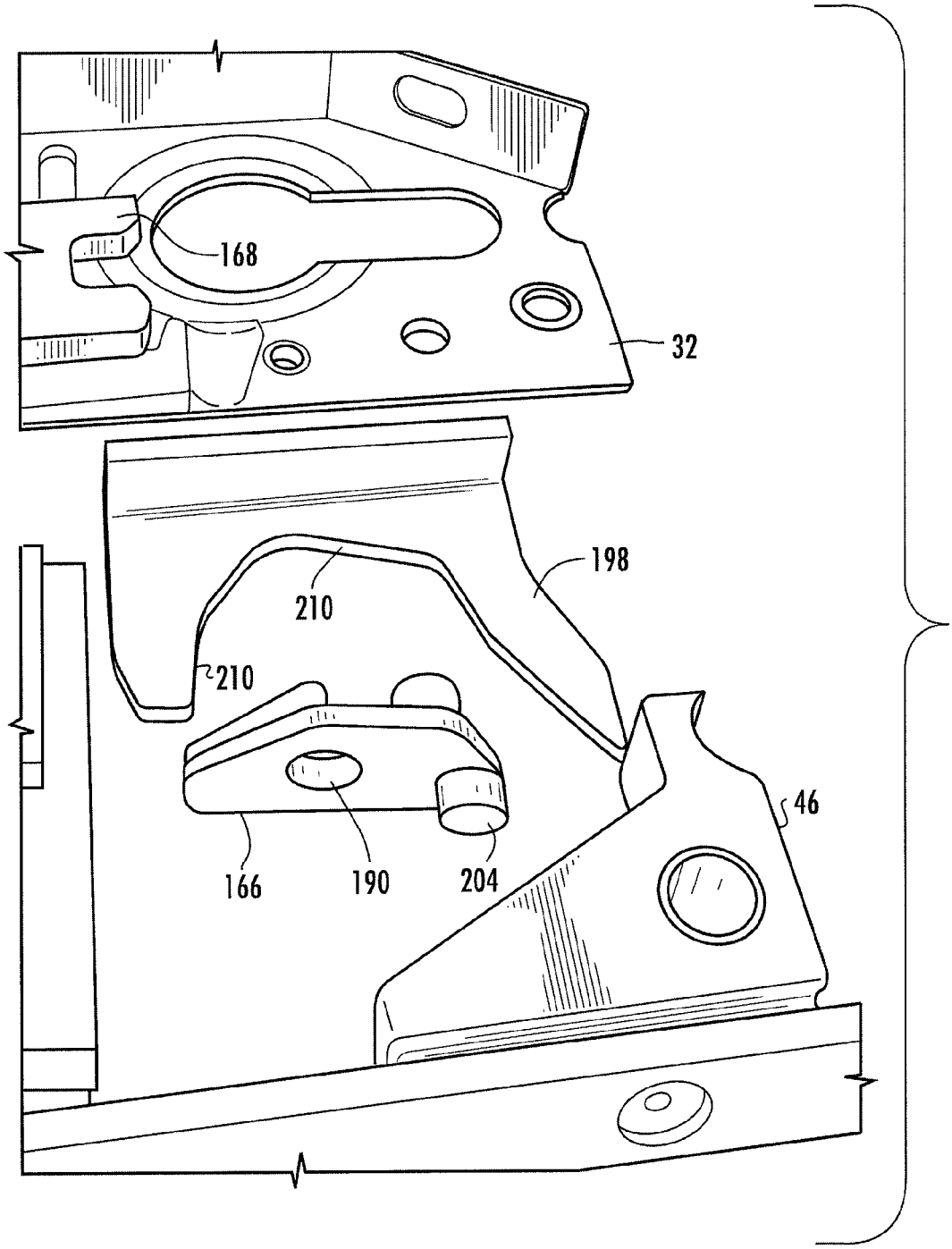
Figure 27:
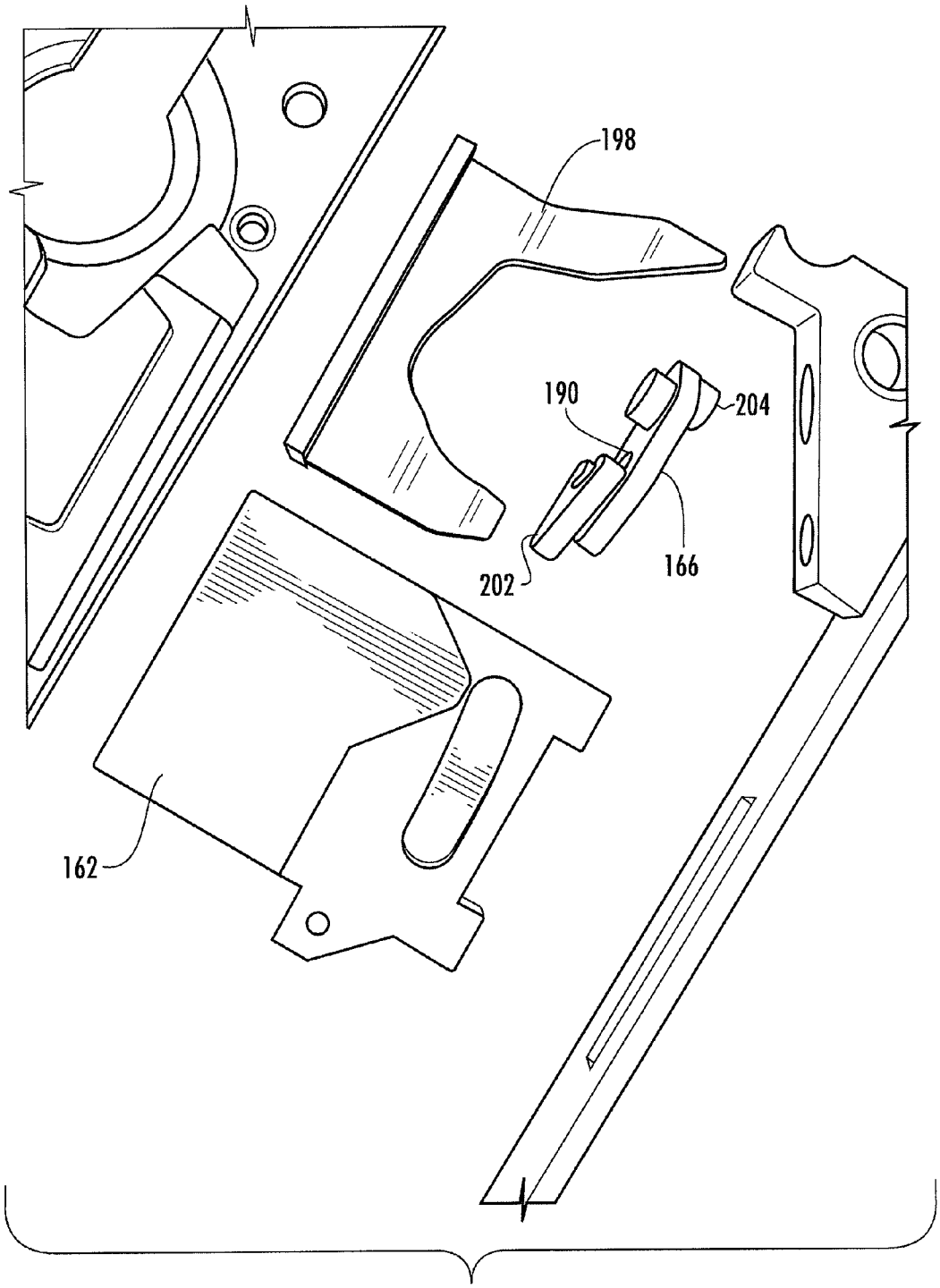
Figure 28:
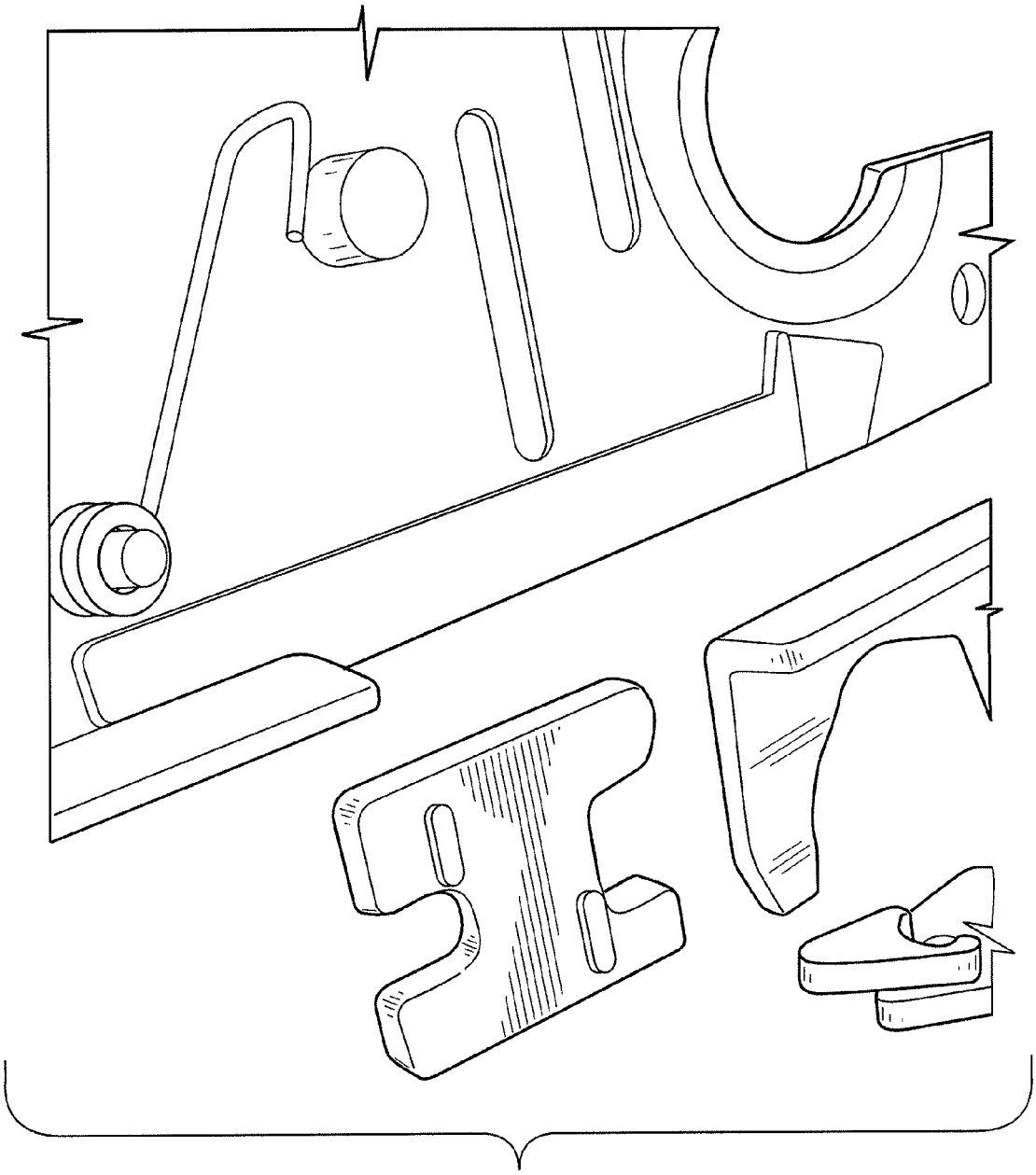
Figure 29:
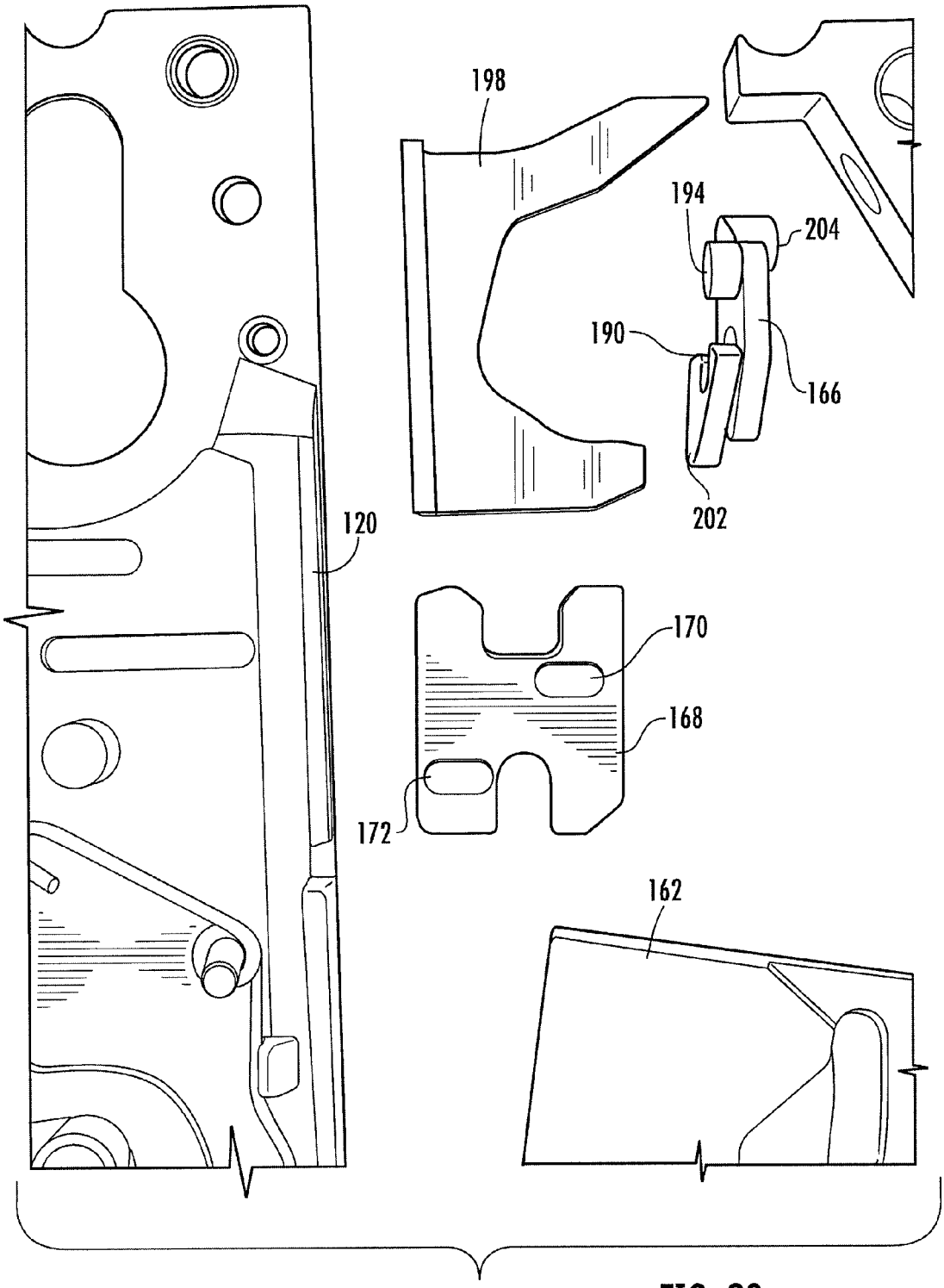
Figure 30:
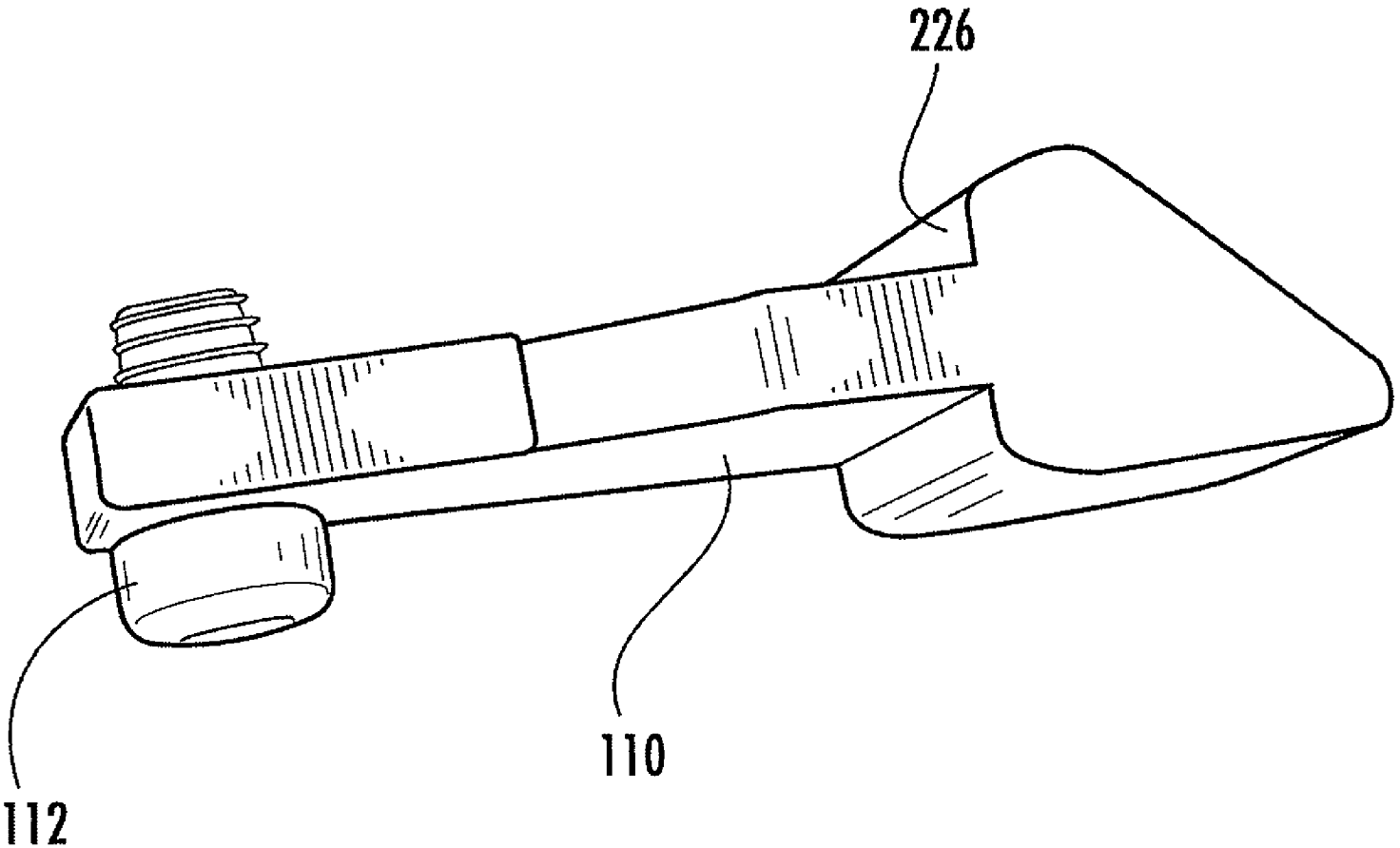
Figure 31:
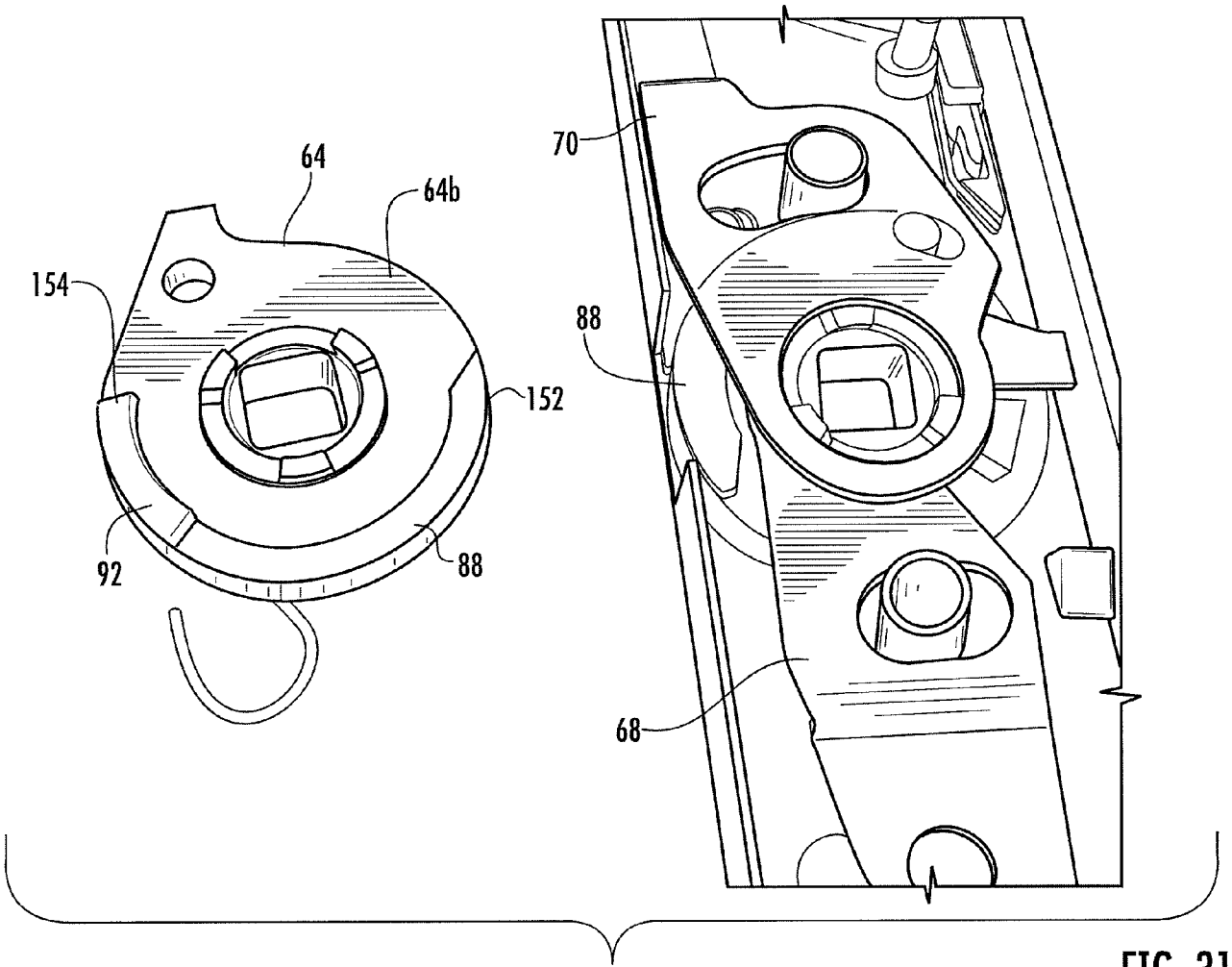
Figure 32:
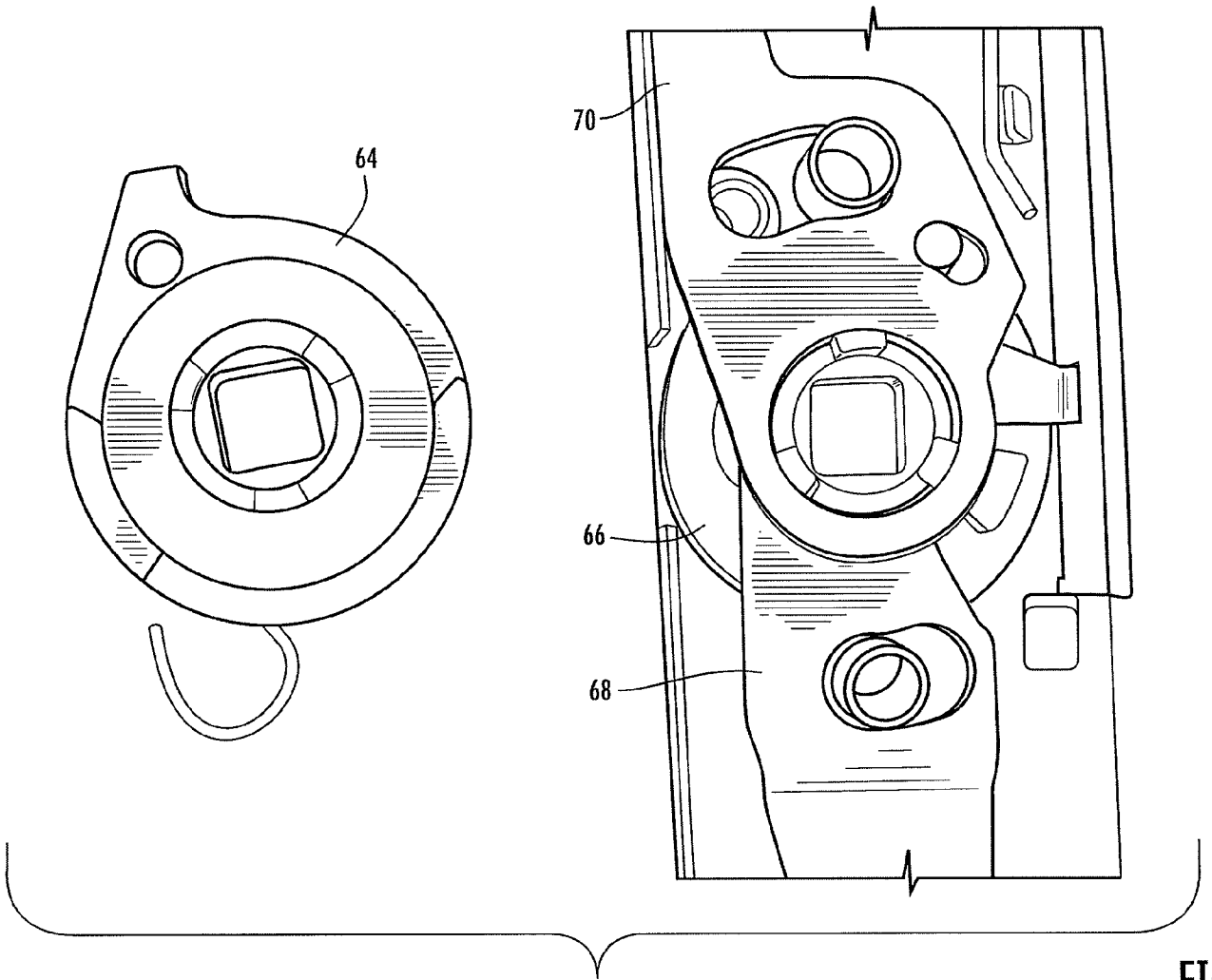
Figure 33:
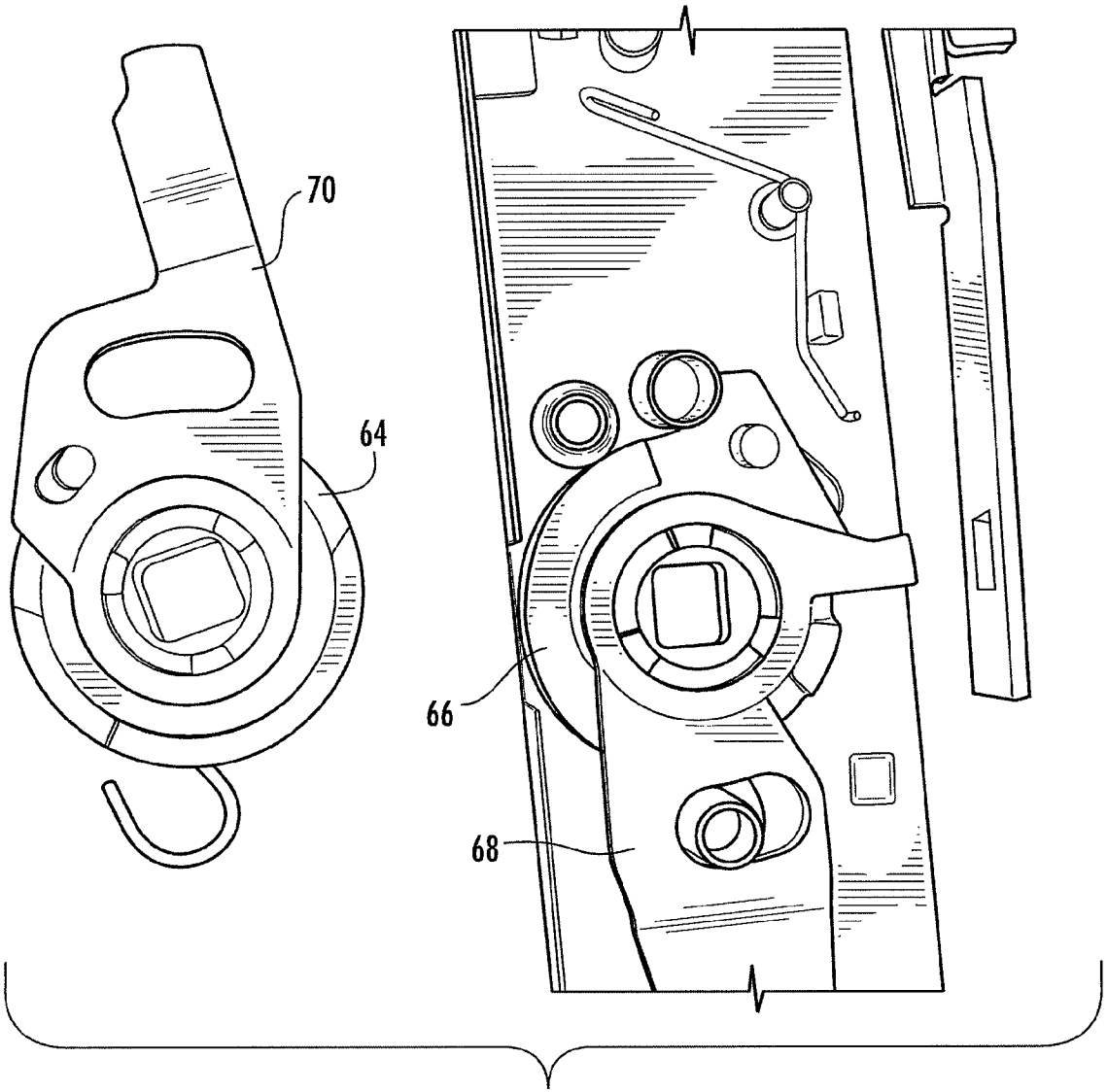
Figure 34:
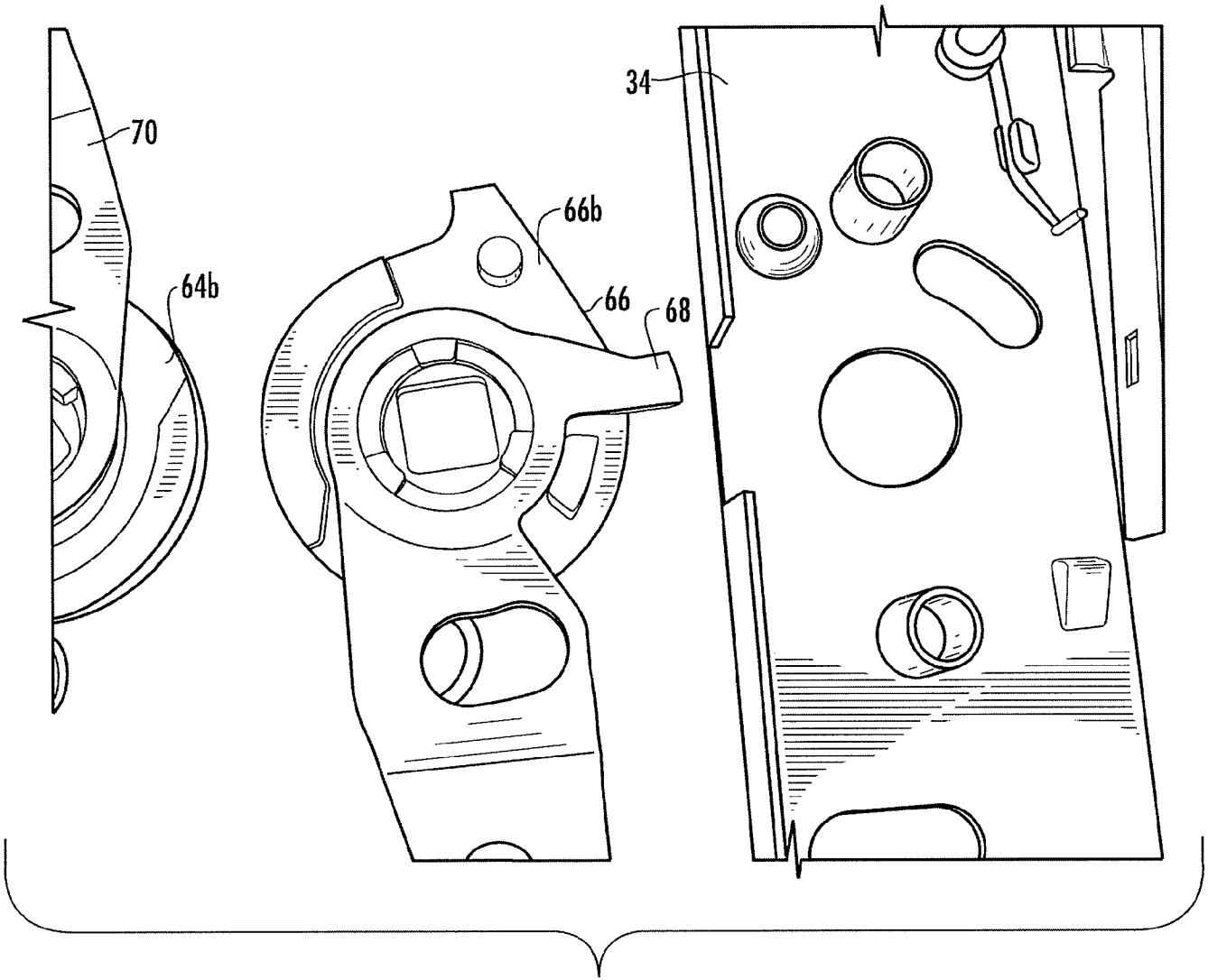
Figure 35:
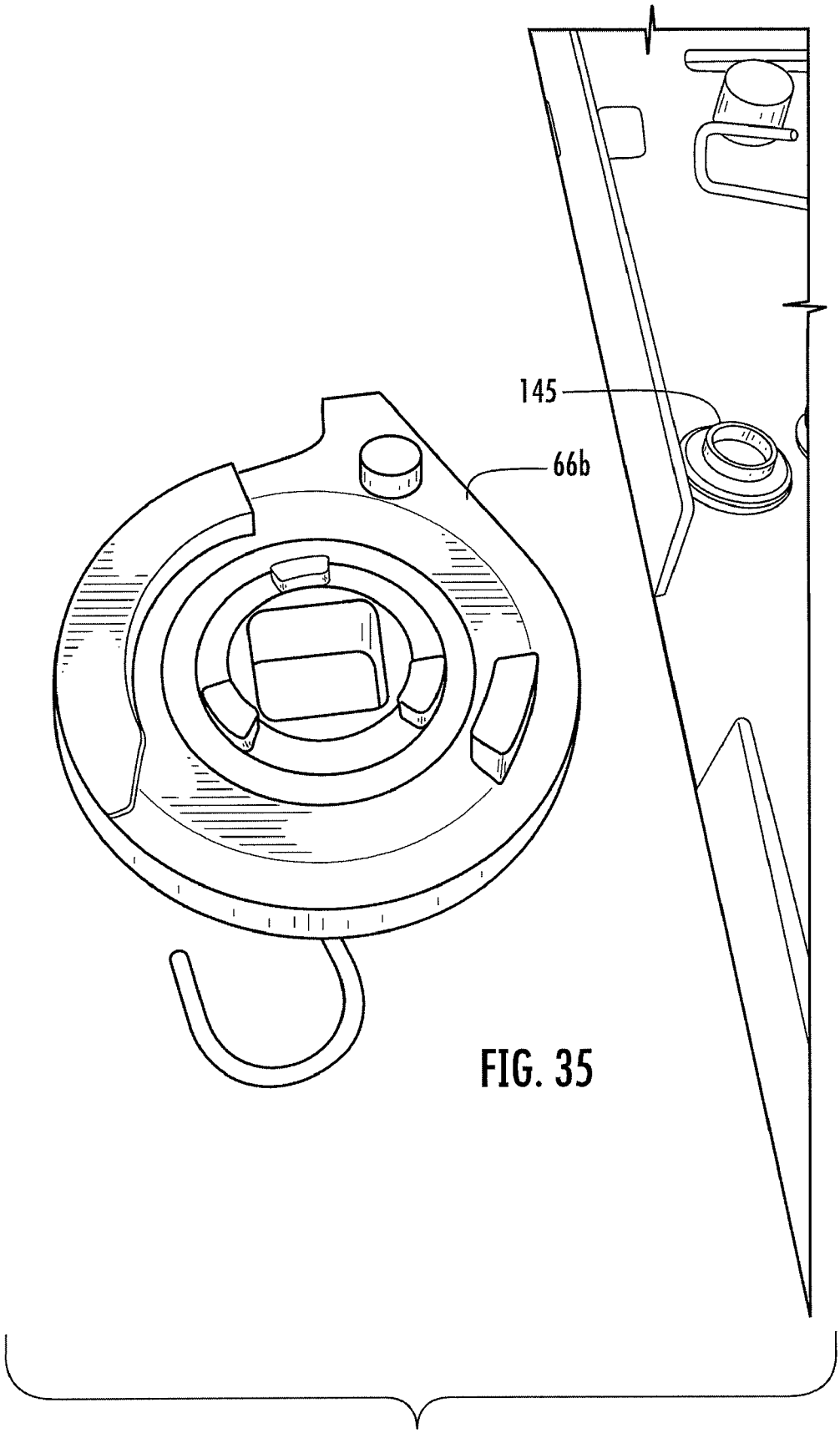
Figure 36:
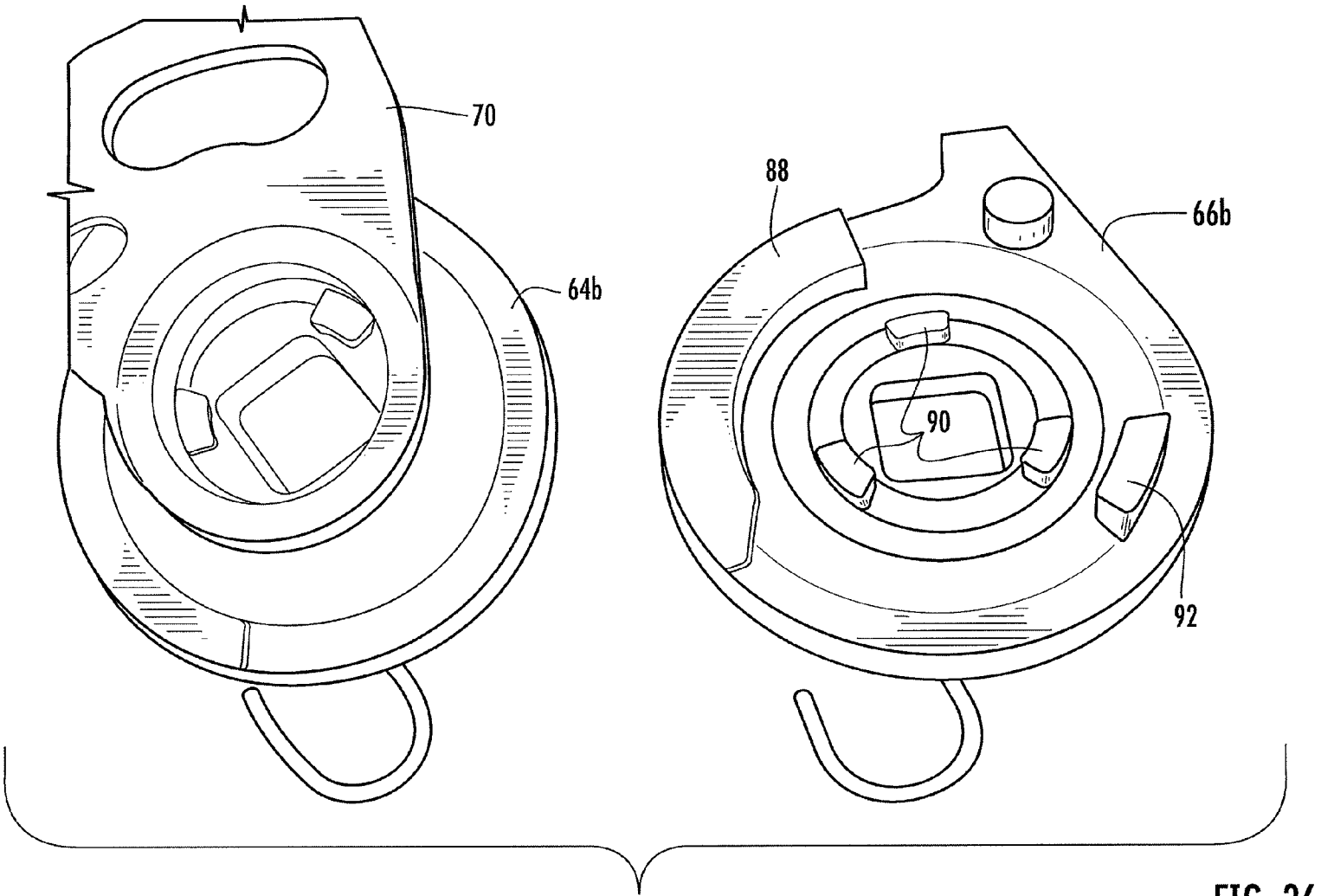
Figure 37:
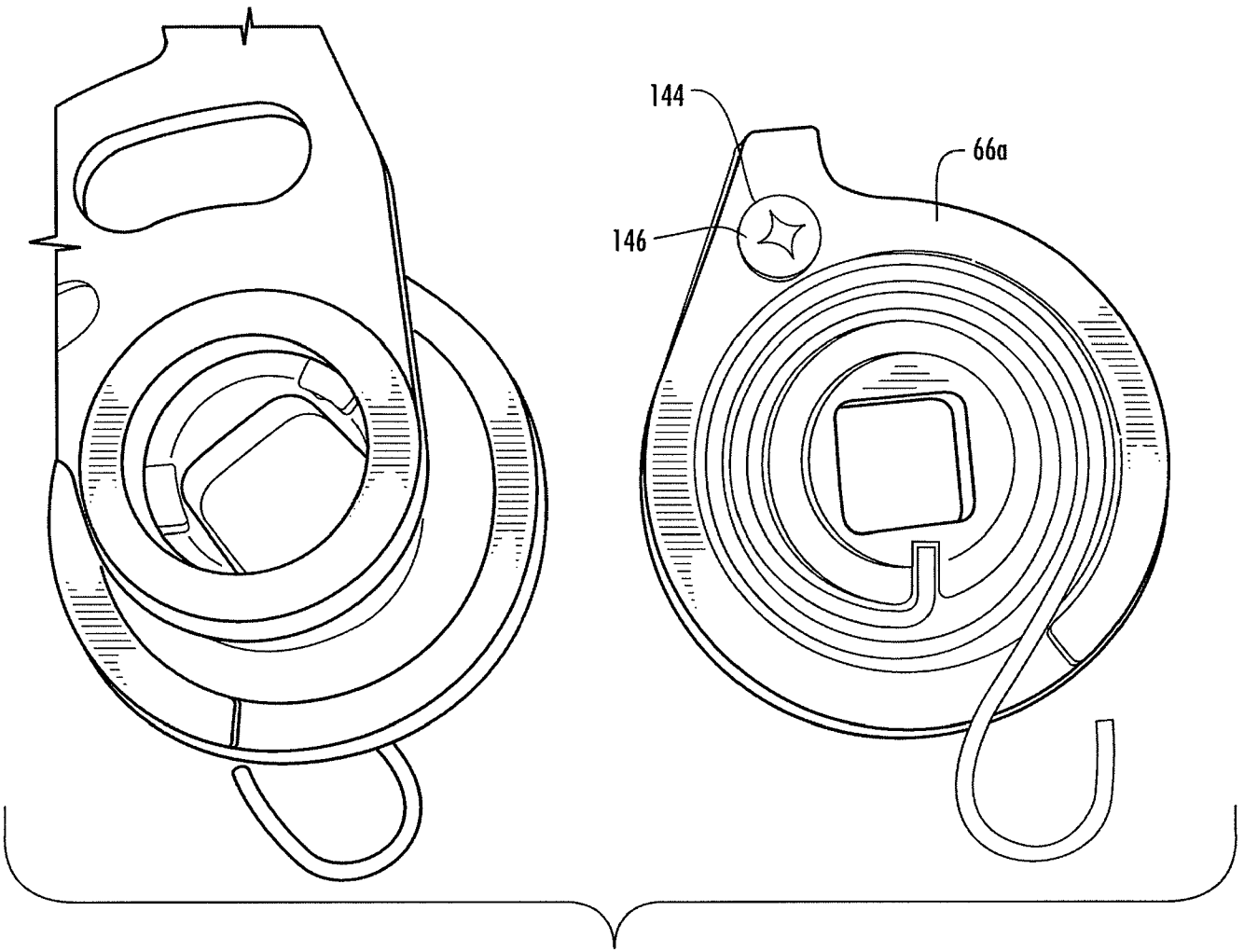
Figure 38:
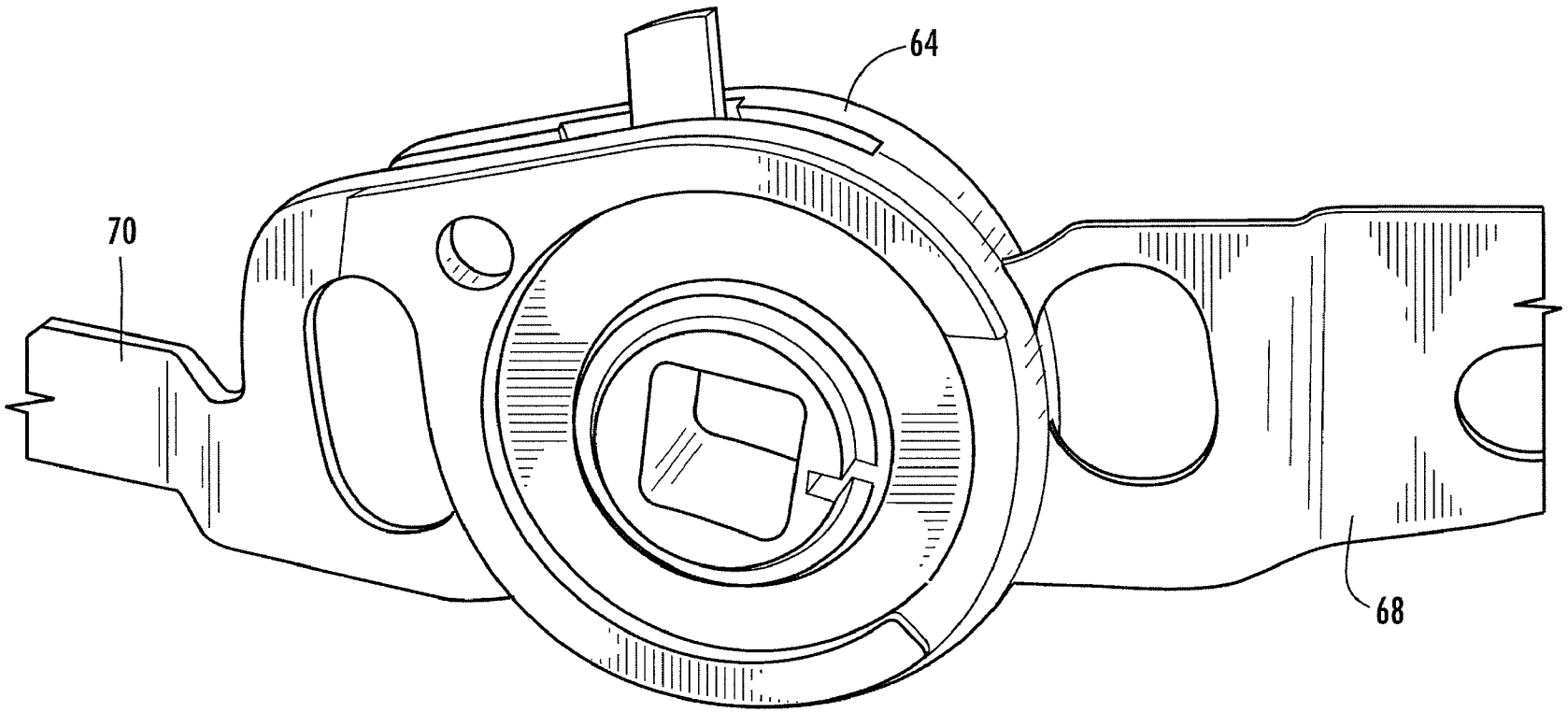
Figure 39:
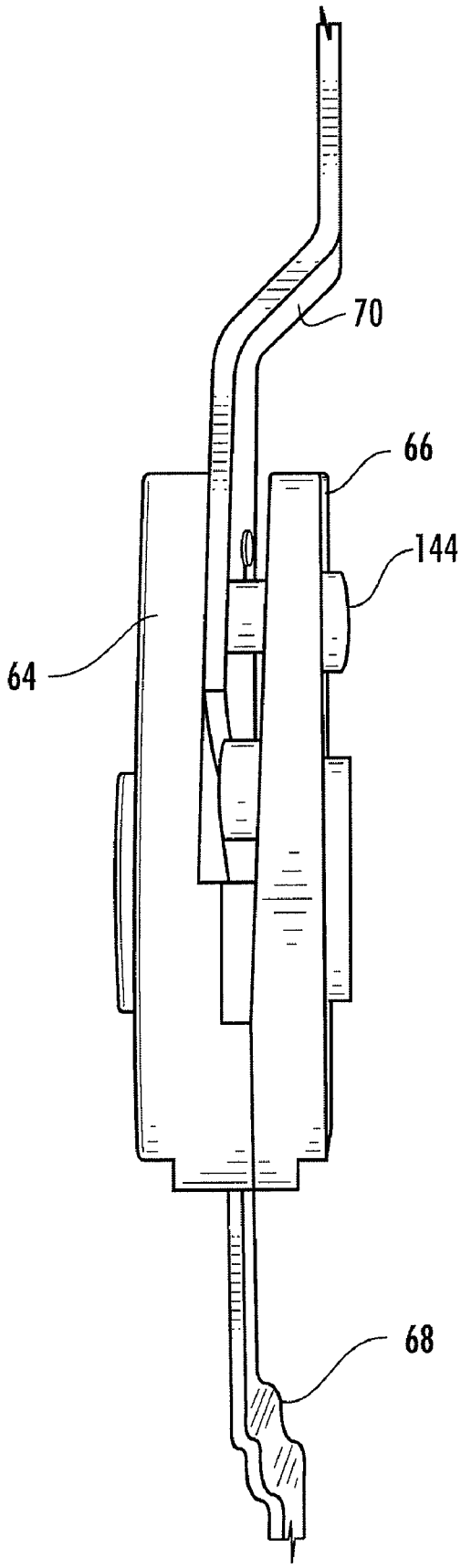
Figure 40:
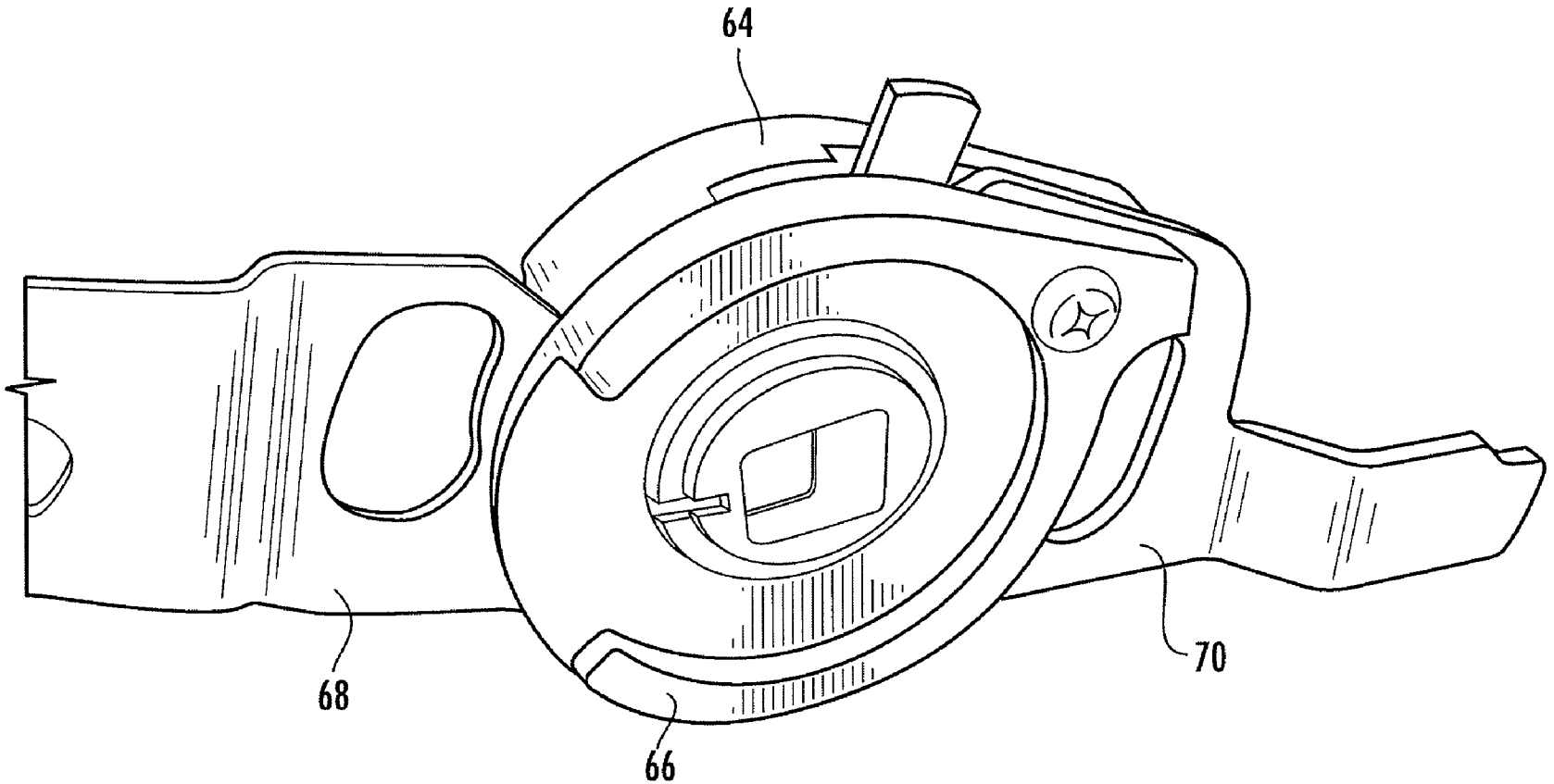
Figure 41:
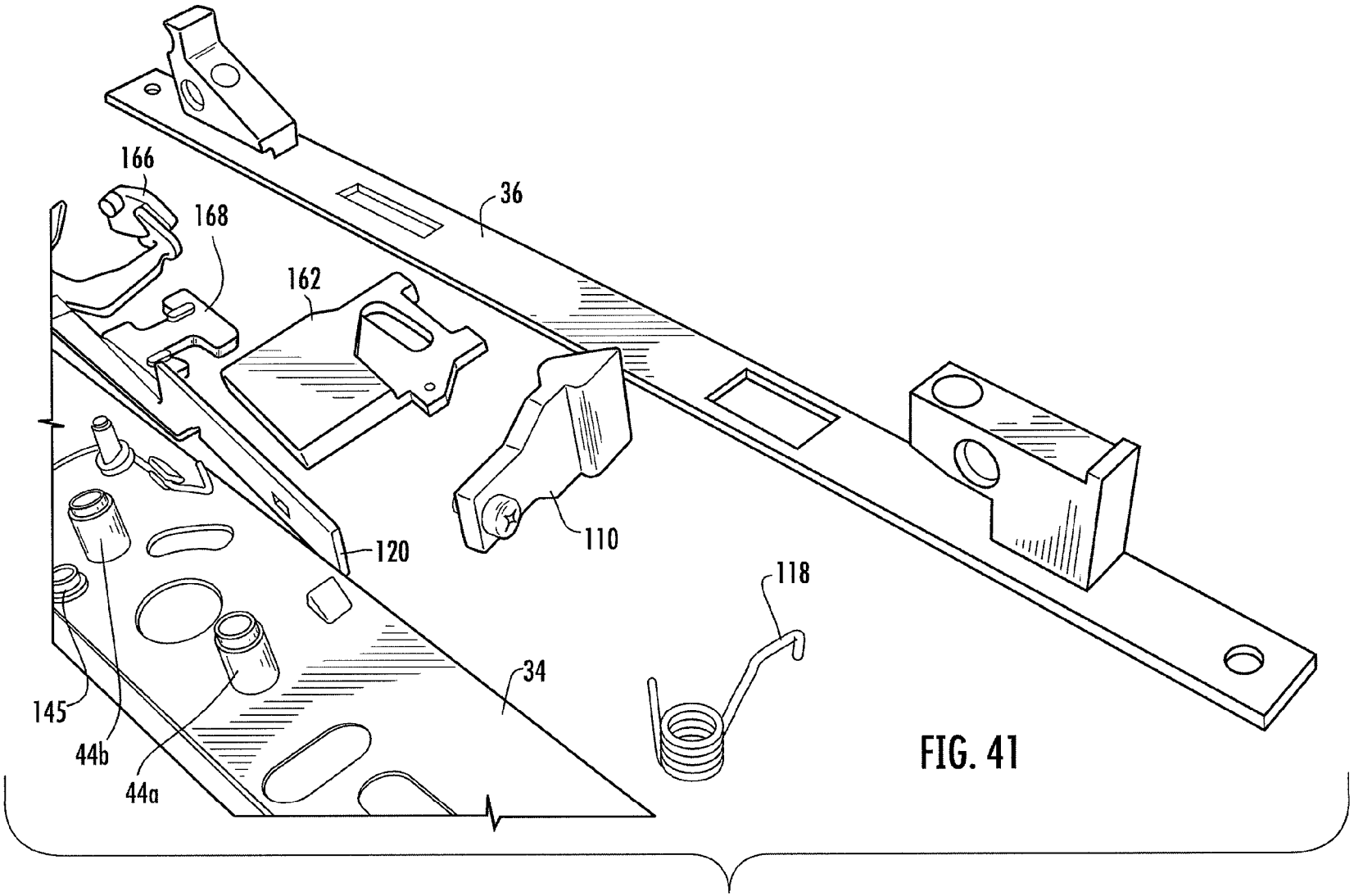

Having thus described the invention in general terms, reference will now be made to the accompanying drawings, which are not necessarily drawn to scale, and wherein:

FIG. 1 is a perspective view illustrating a lock assembly disposed in a door according to one embodiment of the present invention, as seen from an exterior side of the door;

FIG. 2 is a perspective view partially illustrating the lock assembly and door of FIG. 1, as seen from an interior side of the door;

FIG. 3 is an exploded view illustrating the lock assembly of FIG. 1;

FIG. 4 is a plan view illustrating the lock assembly of FIG. 1 with the housing partially unassembled, and shown with the latch assembly in an extended configuration and the deadbolt assembly unlocked;

FIG. 5 is a plan view illustrating the lock assembly of FIG. 1 with a first side member of the housing removed, and shown with the latch assembly in a retracted configuration and the deadbolt assembly unlocked;

FIG. 6 is a plan view similar to FIG. 5, shown with the deadbolt assembly locked;

FIG. 7 is a plan view similar to FIG. 6, shown with the deadbolt assembly locked and the first handle partially rotated to unlock the assembly;

FIG. 8 is a plan view illustrating the lock assembly of FIG. 1 as seen from an opposite direction relative to FIG. 6, shown with a second side member of the housing removed and with the deadbolt assembly unlocked and the second handle rotated to retract the latch member;

FIG. 9 is a plan view similar to FIG. 8, shown with the lock screw removed from the first plate and disposed through the second plate to engage the second plate with the lock link;

FIG. 10 is a plan view similar to FIG. 9, shown with the lock screw removed from the second plate and disposed through the housing and the lock link to engage the lock link to the housing;

FIG. 11 is a perspective view illustrating one of the plates of the latch assembly of the lock assembly of FIG. 1;

FIG. 12 is a plan view illustrating the operation of the two plates, the latch link, and the lock link of the latch assembly of FIG. 1;

FIG. 13 is a partial plan view illustrating a lock assembly according to another embodiment of the present invention, shown with the first side member of the housing removed and with the deadbolt assembly unlocked and the latch member extended;

FIGS. 14-24 are plan views of the lock assembly of FIG. 13;

FIGS. 25-28 are perspective views of the lock assembly of FIG. 13, illustrating members of the deadbolt assembly;

FIG. 29 is a plan view of the lock assembly of FIG. 13, illustrating members of the deadbolt assembly; and FIGS. 30-41 are perspective views of the lock assembly of FIG. 13.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The lock assembly of the present invention is typically provided in a door and used to selectively secure the door in a closed, i.e., locked, position. Referring to the drawings and, in particular, to FIGS. 1 and 2, there is shown a lock assembly 10 of the present invention disposed in a door 12, as seen from an exterior side 16 of the door 12 (FIG. 1) and an interior side 14 of the door 12 (FIG. 2). As illustrated, the door 12 can be a swinging door that is mounted by hinges in a door frame 18 in a wall 20. The lock assembly 10 is typically disposed in a recess or hollowed portion of the door 12 proximate a keeper structure 22 that is provided at a jamb of the door frame 18 so that, when the door 12 is closed, the lock assembly 10 can be used to engage the keeper structure 22 and secure the door 12 in the closed position.

More particularly, the lock assembly 10 can be used to secure the door 12 by latching or locking. By the term "latching," it is generally meant that the door 12 can be opened from either side without a key. By "locking," it is generally meant that a key is required to open the door 12 from the exterior side 16. While the lock assembly 10 is described below in an installation of a swinging exterior door that is engaged to a frame, it will be appreciated that the lock assembly 10 can similarly be used in other types of doors or other portals and/or used to engage another door or other structures. Further, it is appreciated that the door 12 can be, but does not need to be, mounted at an interface between inside and outside areas of a building. Thus, the terms "interior" and "exterior" are generally used to refer to the opposite sides of the door 12 or the areas on the opposite sides of the door 12, and are not meant to require that either side of the door 12 is necessarily directed immediately toward an inside or outside area.

Referring now to FIG. 3, there is shown the lock assembly 10 in an unassembled configuration. As illustrated, the lock assembly 10 includes a housing 30 having first and second side members 32, 34 and a face member 36 that define an interior space therebetween. One or more angled flanges can extend from one edge of the second side member 34 to collectively define a rear wall 40 generally opposite the face member 36. The first and second side members 32, 34 are connected by fasteners 42. Each fastener 42 can be a post-like member that extends through the interior space 38 between corresponding holes 44 defined by the side members 32, 34. Each fastener 42 typically defines a first diameter that is slightly larger than the corresponding holes, and a second diameter that is slightly smaller than the corresponding holes so that the ends of each fastener 42 can be inserted into the corresponding holes. In some cases, the ends of each fastener 42 are deformed or otherwise adjusted after the fastener 42 is disposed through the side members 32, 34 so that the fastener 42 is fixed to both side members 32, 34 and the side members 32, 34 are restrained by the fasteners 42. In other embodiments, other fasteners, such as rivets, screws, clips, or the like, can be used to connect the side members 32, 34. Mounting blocks 46 can also be provided to connect the side members 32, 34 and the face member 36. As illustrated in FIG. 1, each mounting block 46 is configured to be disposed in the interior space 38 of the housing 30 and defines holes for receiving fasteners connecting the mounting block 46 to the side members 32, 34 and the face member 36. In particular, each mounting block 46 can define one or more threaded holes 48*a* that are directed toward the face member 36 such that a screw 50 can be extended through the face member 36 and into the mounting block 46. Holes 48*b* extending through the mounting block 36 in a direction between the side members 32, 34 can receive one of the post-like fasteners 42 or other types of fasteners. In some embodiments, the housing 30 can have other configurations, such as a unitary structure formed of a single member, or of different numbers and configurations of members that are connected to at least partially house the other components of the assembly 10.

The lock assembly 10 generally includes a latch assembly 60 and a deadbolt assembly 62, which can be operated together or separately. The latch assembly 60 includes first and second plates 64, 66 that are rotatably disposed in the housing 30 with a latch link 68 and a lock link 70 disposed therebetween. Each plate 64, 66 defines a first (or outer) side 64*a*, 66*a* that is directed outward toward a respective one of the side members 32, 34, with a spring mounted between the first 64*a*, 66*a* and the respective side member 32, 34. That is, a first spring 72 is mounted between the first 64*a* of the first plate 64 and the first side member 32, and a second spring 74 is mounted between the first side 66*a* of the second plate 66 and the second side member 34. The first 64*a*, 66*a* of each plate 64, 66 is contoured to engage the respective spring. For example, as illustrated, the first side 64*a*, 66*a* of each plate 64, 66 can define an annular recess 76 for receiving one or more coils of the respective spring 72, 74, and a radial slot 78 for receiving an end of the respective spring 72, 74. The opposite end of each spring 72, 74 can be bent to define a hook 80, 82 that engages one of the fasteners 42 extending between the side members 32, 34 of the housing 30. In particular, the first and second springs 72, 74 can be hooked to a first post 42*a*.

Each of the plates 64, 66 defines an aperture 84 for receiving an end of a handle. For example, as shown in FIG. 3, the apertures 84 of the plates 64, 66 can have square cross-sectional shapes. First and second handles 24, 26 are provided on opposite sides of the lock assembly 10. Each handle 24, 26 includes a shaft with a square cross-sectional shape that corresponds to the aperture 84 of the respective plate 64, 66. Thus, the first handle 24 is configured to engage the first plate 64 so that the first plate 64 can be rotated by the first handle 24, and the second handle 26 is configured to engage the second plate 66 so that the second plate 66 can be rotated by the second handle 26. In the embodiment of FIG. 1, the shaft of each handle 24, 26 does not extend into the lock assembly 10 beyond the respective plate 64, 66. That is, the first handle 24 does not engage the second plate 66, and the second handle 26 does not engage the first plate 64.

The second (inner) side 64*b*, 66*b* of each plate 64, 66 is also contoured. In particular, each second side 64*b*, 66*b* defines an inner ridge 86 that extends circumferentially around the aperture 84, and an outer ridge 88 that extends circumferentially about a portion of the periphery of the plate 64, 66. The inner ridges 86 correspond in shape and size to corresponding bores 69, 71 defined by the latch and lock links 68, 70, respectively. Tabs 90 extend inwardly from the inner ridges 86, and the tabs 90 are positioned at different circumferential positions on the first and second plates 64, 66 so that the second sides 64*b*, 66*b* of the plates 64, 66 can be disposed toward each other, with the tabs 90 of the first plate 64 disposed against the inner ridge 86 of the second plate 66, and with the tabs 90 of the second plate 66 disposed against the inner ridge 86 of the first plate 64. In this configuration, inner surfaces of the first and second plates 64, 66 are disposed toward one another, with a space therebetween in which the latch and lock links 68, 70 are disposed. Further, the tabs 90 extending from the first and second plates 64, 66 define circumferential spaces therebetween so that the first and second plates 64, 66 can be rotated relative to one another through a limited range of rotational motion. The outer ridges 88 contact each other and, as the first and second plates 64, 66 are rotated relative to one another, the outer ridge 88 of the first plate 64 slides against the outer ridge 88 of the second plates 66.

Each plate 64, 66 also defines a tab 92 that extends from the second (inner) surface 64*b*, 66*b* thereof in an inward direction toward the opposite plate 64, 66. In other words, the tab 92 defined by the first plate 64 extends toward the second plate 66, and the tab 92 defined by the second plate 66 extends toward the first plate 64. The tabs 92 are located at different radial distances from the center of rotation of the plates 64, 66. In particular, the tab 92 of the first plate 64 is positioned radially beyond the tab 92 of the second plate 66. Thus, when the plates 64, 66 are rotated relative to one another, the tab 92 of the first plate 64 slides against the surface 66*b* of the second plate 66 and the tab 92 of the second plate 66 slides against the surface 64*b* of the first plate 64 without the two tabs 92 contacting one another to prevent the relative rotation of the plates 64, 66.

The latch link 68 is configured to be selectively rotationally adjusted by the tabs 92 and, hence, by the rotation of the handles 24, 26 and plates 64, 66. In this regard, the latch link 68 defines an arm 100 that extends generally radially outwardly from the shafts of the handles 24, 26. The arm 100 is disposed between the second (inner) surface 66*b* of the second plate 66 and the outer ridge 88 of the first plate 64. The latch link 68 is configured to rotate relative to the plates 64, 66, but the rotation of the latch link 68 relative to the plates 64, 66 is limited or constrained in one rotational direction by a step 102 defined by the outer ridge 88 of the second plate 66, and in the opposite rotational direction by each of the tabs 92.

A flange 104 of the latch link 68 extends from the plates 64, 66 and defines a mounting aperture 106 and a connection portion 108. The mounting aperture 106 is typically an elongated bore, i.e., a hole through the flange defining an oval or otherwise non-circular perimeter. The first post 42*a* extends through the aperture 106 so that the latch link 68 is constrained to rotate about an axis of the shafts through a limited arc of motion. The connection portion 108 of the flange 104 is located opposite the aperture 106 from the bore 69 through which the inner ridges 86 of the plates 64, 66 extend. The connection portion 108 is connected to a latch member 110 so that the latch member 110 is configured to be adjusted by the motion of the latch link 68. In particular, the connection portion 108 can be a hole or slot, and a latch screw or pin 112 can be disposed through the slot and engaged with a hole 114 in the latch member 110 so that the latch member 110 is pinned to the latch link 68. The latch member 110 extends through a rectangular aperture 116 in the face member 36 of the housing 30 and is thereby constrained to move in a generally linear motion between a retracted position (FIGS. 5 and 7) and an extended position (FIGS. 4 and 6). Further, a latch spring 118 can be provided between the housing 30 (e.g., against a flap provided in the housing 30 or against the rear wall 40) and the latch member 110 or latch link 68 to bias the latch member 110 to the extended position.

The arm 100 of the latch link 68 can also extend generally toward, but not into, the face member 36. A catch plate 120 is adjustably mounted along the face member 36 and defines an aperture 122 for receiving the arm 100 of the latch link 68. Thus, as latch link 68 rotates, the arm 100 adjusts the catch plate 120 in a sliding motion parallel to the face member 36. In particular, as the latch link 68 rotates clockwise, and the flange 104 of the latch link 68 moves away from the face member 36 to retract the latch member 110, the arm 100 adjusts the catch plate 120 in a direction away from the deadbolt assembly 62. As the latch link 68 rotates counterclockwise, and the flange 104 of the latch link 68 moves toward the face member 36 to extend the latch member 110, the arm 100 adjusts the catch plate 120 in a direction toward the deadbolt assembly 62.

The catch plate 120 can be configured to slide against the face member 36, i.e., with the catch plate 120 and the face member 36 in direct sliding contact, as illustrated in the embodiment shown in FIGS. 13-41. Alternatively, as illustrated in FIGS. 1-12, the catch plate 120 can be spaced from the face member 36 by a guide spacer 124 that is disposed between the catch plate 120 and the face member 36. The guide spacer 124 is a generally block-like member that is connected to the side members 32, 34 of the housing 30 to remain stationary during operation of the latch and deadbolt assemblies 60, 62. In particular, the guide spacer 124 can define integral posts 126 extending therefrom to engage corresponding apertures 128 in the side members 32, 34, and/or the guide spacer 124 can define one or more apertures 130, each aperture 130 being configured to receive one of the fasteners 42 that extends through the spacer 124 and into a corresponding one of the holes 44 in each side member 32, 34. The guide spacer 124 can define a first surface 132 directed toward the face member 36 and a second surface 134 that is opposite and parallel to the first surface 132. Thus, the catch plate 120 can slide along the second surface 134 of the guide spacer 124 and thereby be maintained in a spaced relationship to the face member 36. In this way, the guide spacer 124 can be used to modify the size and configuration of the lock assembly 10. More particularly, the guide spacer 124 can be used to modify the backset of the lock assembly 10, i.e., the distance between the center of rotation of the handles 24, 26 (i.e., the center of the apertures 84 in the plates 64, 66) and the outer surface of the face member 36. In this regard, it is appreciated that the width of the guide spacer 124, as defined between the first and second surfaces 132, 134 of the spacer 124, can be modified to provide any desired space between the catch plate 120 and the face member 36. In one embodiment, the width of the guide spacer 124 can provide a sufficient space between the latch assembly 60 and the face member 36 so that the backset is about 35 millimeters. In other embodiments, the width of the guide spacer 124 and the dimensions of the side members 32, 34 of the housing 30 can be modified to provide a greater or lesser backset. As noted above, the guide spacer 124 can be omitted so that the catch plate 120 slides against the face member 36, e.g., where a small backset is desired, such as a backset of about 25 millimeters.

The lock link 70 is selectively configured to be rotationally adjusted by either of the plates 64, 66 and, hence, by a respective one of the handles 24, 26. In this regard, the lock link 70 defines an elongated aperture 140 at a position that corresponds radially to threaded apertures 142 through the plates 64, 66. The lock link 70 is connected to one of the plates 64, 66 by a lock screw 144. The lock screw 144 defines a head 146, a threaded portion 148 closest thereto, and an unthreaded pin-like portion 150 extending from the threaded portion 148 opposite the head 146. Thus, the lock screw 144 can be screwed into the aperture 142 of the first plate 64 (FIG. 4) and advanced in a direction toward the second plate 66 until the unthreaded portion 150 extends through the aperture 140 of the lock link 70. Alternatively, the lock screw 144 can be screwed into the aperture 142 of the second plate 66 (FIG. 9) and advanced in a direction toward the first plate 64 until the unthreaded portion 150 extends through the aperture 140 of the lock link 70. In either case, the lock screw 144 only engages the lock link 70 to one of the plates 64, 66. That is, when the lock screw 144 is screwed into the first plate 64 (FIG. 4), the lock screw 144 does not engage the threaded aperture 142 of the second plate 66. Similarly, when the lock screw 144 is screwed into the second plate 66 (FIG. 9), the lock screw 144 does not engage the threaded aperture 142 of the first plate 64.

The lock link 70 is disposed between the second (inner) surface 64*b* of the first plate 64 and the outer ridge 88 of the second plate 66. Further, the lock link 70 is disposed between a step 152 defined by the outer ridge 88 of the first plate 64 and another step 154 defined by the opposite end of the outer ridge 88 of the first plate 64. In addition, the tab 92 extending from the second plate 66 is configured to selectively limit the rotational movement of the lock link 70. As noted above, the lock link 70 is configured to be connected to one of the plates 64, 66 so that the lock link 70 can rotate relative to only one of the plates 64, 66.

A flange 156 of the lock link 70 extends from the plates 64, 66 and defines a mounting aperture 158 and a driving feature 160. The mounting aperture 158 is typically an elongated bore, i.e., a hole through the flange 156 defining an oval or otherwise non-circular perimeter. A second post 42*b* extends through the aperture 158 so that the lock link 70 is constrained to rotate about an axis of the shafts through a limited arc of motion. The driving feature 160 of the flange 156 is located opposite the aperture 158 from the bore 71 through which the inner ridges 86 of the plates 64, 66 extend. The driving feature 160 can be configured to adjust a motion of the deadbolt assembly 62, as described below.

The deadbolt assembly 62 includes a deadbolt member 162 that is configured to be adjusted between a retracted position (FIGS. 4, 5 and 7) and an extended position (FIG. 6). In the extended position, the deadbolt member 162 is extended from the housing 30 toward the keeper structure 22 at the jamb of the door frame 18 and engaged with the keeper structure 22 to secure the door 12 in a locked configuration. In the retracted position, the deadbolt member 162 is generally moved toward and/or into the housing 30 and thereby disengaged from the keeper structure 22 so that the door 12 is adjusted to an unlocked configuration. The deadbolt member 162 extends through a rectangular aperture 164 in the face member 36 of the housing 30 and is thereby constrained to move in a generally linear motion between the retracted position and the extended position.

The deadbolt member 162 is actuated by a driver member 166 and a link member 168 of the deadbolt assembly 62. The link member 168 is an H-shaped member with two protrusions 170, 172 configured to be disposed in corresponding slots 174, 176 defined by the second side member 34 of the housing 30. The slots 174, 176 extend in a direction generally perpendicular to the face member 36, so that the link member 168 is constrained to slide in the same direction, toward and away from the face member 36. A first end of the link member 168 defines a notch 178 or other connection feature for engaging a key lock mechanism 182, and a second, opposite end of the link member 168 defines a notch 180 or other connection feature for engaging a first protrusion 194 extending from the driver member 166.

The key lock mechanism 182 typically includes a cylindrical lock device having a deadbolt handle 184 on one side and a keyhole 186 on the opposite side. The deadbolt handle 184 can be disposed at the interior side 14 of the door 12, and the keyhole 186 can be disposed at the exterior side 16 of the door 12, so that the key lock mechanism 182 can be adjusted from the interior side 14 by rotating the deadbolt handle 184 or from the exterior side 16 by inserting a key into the lock device and rotating the key. Various types of lock mechanisms can be provided and used for the key lock mechanism 182. For example, the key lock mechanism 182 can include a cylindrical disc tumbler lock device that has an outer cylinder with a series of flat, spring-loaded discs therein, the discs being structured to be arranged in a predetermined configuration when the key having a particular profile is inserted. As the lock device is rotated, either by the deadbolt handle 184 or by the key, a drive arm 188 extending from the lock device also rotates. The drive arm 188 extends from the lock device and is disposed in the slot, notch 178, or other connection feature defined by the first end of the link member 168. Thus, as the lock device is rotated in a first direction (counterclockwise in FIGS. 5 and 6), the link member 168 is adjusted toward the face member 36 of the housing 30 and the deadbolt member 162 is extended to engage the keeper structure 22; and as the lock device is rotated in a second, opposite direction (clockwise in FIGS. 5 and 6), the link member 168 is adjusted away from the face member 36 and the deadbolt member 162 is retracted from the keeper structure 22. The lock assembly 10 can be provided with a single key lock mechanism 182 that is configurable to operate with the deadbolt handle 184 and the keyhole 186 directed in either direction from the assembly. In other words, the installer can dispose or configure the lock assembly 10 in the housing 30 so that the deadbolt handle 184 extends from the side of the assembly that will be disposed at the interior side 14 of the door 12 and the keyhole 186 is disposed on the exterior side 16 of the door 12.

The driver member 166 defines a mounting aperture 190 configured to receive a post 192 extending from, and fixed to, the second side member 34 of the housing 30 so that the driver member 166 is configured to rotate about the post 192. The rotation of the driver member 166 is actuated by the link member 168 by virtue of the connection of the first protrusion 194 of the driver member 166 and the notch 180 of the link member 168. That is, as the link member 168 is moved in a direction toward the face member 36, the driver member 166 is rotated in a clockwise direction (as illustrated in FIGS. 5 and 6; or counter-clockwise as seen from the opposite side in FIGS. 9 and 10), and as the link member 168 is moved in a direction away from the face member 36, the driver member 166 is rotated in an opposite direction (i.e., counterclockwise in FIGS. 5 and 6, or clockwise in FIGS. 9 and 10). A body portion of the driver member 166 defines a cam shape 196 that corresponds to a contoured cam profile 200 of a retainer member 198 so that the retainer member 198 retains and guides the motion of the driver member 166. The driver member 166 also defines an arm 202 extending from the body portion, the arm 202 being configured to contact the driving feature 160 of the lock link 70 so that the driving feature 160 can be rotated by the lock link 70 as described below.

A second protrusion 204 extends from the driver member 166 in a direction opposite the first protrusion 194. The second protrusion 204 is configured to move in through an arc of motion as the link member 168 is adjusted and the driver member 166 rotates. The second protrusion 204 is disposed in a slot 206 defined by the deadbolt member 162 so that the second protrusion 204 controls a motion of the deadbolt member 162. The slot 206 in the deadbolt member 162 can be slightly curved but generally extends in a direction perpendicular to the direction of motion of the deadbolt member 162. That is, the slot 206 extends in a direction generally parallel to the face member 36 of the housing 30 so that, as the second protrusion 204 of the driver member 166 is adjusted through an arc of motion, the second protrusion 204 is adjusted along the slot 206 and the deadbolt member 162 moves linearly between the retracted and extended positions.

The retainer member 198 defines an angle shape, with a first face 208 that is directed toward the rear wall 40 defined by one of the angled flanges of the housing 30, so that the retainer member 198 is configured to move in a direction perpendicular to the motion of the deadbolt member 162 with the first face 208 in sliding engagement with the rear wall 40. The retainer member 198 is disposed against a side surface of the link member 168 and a side surface of the arm 202 of the driver member 166. As the driver member 166 is rotated, the contoured cam profile 200 defined by the retainer member 198 contacts the cam shape 196 of the body portion of the driver member 166 to guide the motion of the driver member 166. The contoured cam profile 200 defined by the retainer member 198 and the cam shape 196 of the body portion of the driver member 166 define corresponding flats 210 so that, with the driver member 166 adjusted to positions where the flats 210 contact, the driver member 166 is biased to a stable or non-moving configuration until acted upon for further rotation.

A deadbolt spring 212 can be provided to bias the retainer member 198 toward the driver member 166. For example, the deadbolt spring 212 can define one or more coils that are disposed around one of the fasteners 42 extending between the side members 32, 34 of the housing 30, and the deadbolt spring 212 can define one end disposed against the housing 30 (e.g., against a flap provided in the housing 30) and another end disposed against the retainer member 198, as shown in FIG. 4. Thus, the deadbolt spring 212 biases the retainer member 198 against the driver member 166 in a direction generally toward the key lock mechanism 182. As the key lock mechanism 182 is used to extend the deadbolt member 162 by rotating the driver member 166, the driver member 166 is urged against the contoured cam profile 200 of the retainer member 198 and overcomes the bias of the deadbolt spring 212 to move the retainer member 198 away from the key lock mechanism 182. Thus, the retainer member 198 is moved away from the key lock mechanism 182 and held against the driver member 166 so that the corresponding surfaces 200, 196 of the retainer member 198 and the driver member 166 engage.

The deadbolt member 162 has a shoulder 214 defining a contoured profile for engaging the contoured cam profile 200 defined by the retainer member 198. The contoured cam profile 200 of the retainer member 198 can at least partially guide the motion of the shoulder 214 and, hence, the deadbolt member 162, as the deadbolt member 162 is adjusted between the retracted and extended positions.

A clamping slider 216 is adjustably mounted to the housing 30 and configured to interact with the latch assembly 60 when the deadbolt assembly 62 is locked, e.g., to prevent the handle 26 at the exterior side 16 of the door 12 from being used to retract the latch member 110 when the lock assembly 10 is locked. The clamping slider 216 defines elongated, or slot-like, apertures 218. Pins 219 extending between the side members 32, 34 of the housing 30 pass through the apertures 218 so that the clamping slider 216 is configured to adjust through a limited range of motion, e.g., in a linear direction perpendicular to the direction of adjustment of the link member 168 and the deadbolt member 162. The clamping slider 216 also defines an angled slot 220 that receives a pin 222 extending from the deadbolt member 162. The angled 220 slot is configured so that the clamping slider 216 is actuated as the deadbolt member 162 is adjusted but in a perpendicular direction. More particularly, as the deadbolt member 162 is adjusted to the locked and unlocked positions, the clamping slider 216 is adjusted toward and away from the latch assembly 60, respectively. When the deadbolt member 162 is locked and the clamping slider 216 is adjusted toward the latch assembly 60, a flange 224 of the clamping slider 216 is extended to engage a corresponding shoulder 226 of the latch member 110, such that the latch member 110 is disposed against the clamping slider 216 and the clamping slider 216 prevents the latch member 110 from being retracted to its unlocked position. When the deadbolt member 162 is unlocked and the clamping slider 216 is adjusted away the latch assembly 60, the flange 224 of the clamping slider 216 is retracted and disengaged from the latch member 110 so that the latch member 110 can be retracted.

With the lock assembly 10 installed in the door 12, the assembly 10 can be operated from the interior and exterior sides 14, 16 of the door 12. In particular, in one embodiment, the first side member 32 of the housing 30 is disposed at the interior side 14 of the door 12 and the lock screw 144 is disposed through the first plate 64 and into the aperture 140 defined by the lock link 70. With the lock assembly 10 unlocked, i.e., the deadbolt member 162 retracted, a person can retract the latch member 110 by turning the first handle 24 at the interior side 14 of the door 12 (clockwise, relative to the perspective of a person facing the interior side 14 of the door 12) or the second handle 26 at the exterior side 16 of the door 12 (counterclockwise, relative to the perspective of a person facing the exterior side 16 of the door 12), such that the door 12 can be opened.

In particular, when the deadbolt assembly 62 is unlocked, and one of the handles 24, 26 is rotated in the appropriate direction, the corresponding plate 64, 66 rotates with the handle 24, 26. That is, when the first handle 24 is turned clockwise, the shaft of the first handle 24 rotates the first plate 64 clockwise. The first plate 64 rotates clockwise until the tab 92 of the first plate 64 contacts the latch member 110. With further rotation of the first handle 24 and the first plate 64, the latch link 68 is rotated clockwise by the tab 92, and the flange 104 of the latch link 68 moves away from the face member 36, thereby overcoming the bias of the latch spring 118 and retracting the latch member 110. When the first handle 24 is released, the bias of the latch spring 118 urges the flange 104 of the latch link 68 toward the face member 36, thereby rotating the latch link 68, the first plate 64, and the first handle 24 in the counterclockwise direction.

Similarly, when the deadbolt assembly 62 is unlocked and the second handle 26 is turned counterclockwise (from the perspective of a person facing the second handle 26), the shaft of the second handle 26 rotates the second plate 66 counterclockwise. The second plate 66 rotates counterclockwise until the tab 92 of the second plate 66 contacts the latch member 110. With further rotation of the second handle 26 and the second plate 66, the latch link 68 is rotated counterclockwise by the tab 92, and the flange 104 of the latch link 68 moves away from the face member 36, thereby overcoming the bias of the latch spring 118 and retracting the latch member 110. When the second handle 26 is released, the bias of the latch spring 118 urges the flange 104 of the latch link 68 toward the face member 36, thereby rotating the latch link 68, the second plate 66, and the second handle 26 in the clockwise direction.

The door 12 can be locked, either by turning the deadbolt handle 184 at the interior side 14 of the door 12 or inserting and rotating the key in the keyhole 186 from the exterior side 16 of the door 12. With the door 12 in the locked configuration, the door 12 can be unlocked from the exterior side 16 of the door 12 by again inserting the key in the keyhole 186 and rotating the key in the opposite direction. A person at the interior side 14 of the door 12 can unlock the door 12 without using the deadbolt handle 184, i.e., by simply turning the first handle 24. As the first handle 24 is rotated clockwise, the shaft of the first handle 24 rotates the first plate 64. The first plate 64 is connected to the lock link 70 by the lock screw 144, and the lock link 70 thus rotates clockwise with the first plate 64 so that the driving feature 160 of the lock link 70 contacts the arm 202 of the driver member 166. As the lock link 70 rotates and drives the arm 202 of the driver member 166 toward the face member 36, the lock driver member 166 rotates counter-clockwise about the post 192, and the post 190 engaged with the deadbolt member 162 retracts the deadbolt member 162, thereby unlocking the assembly 100. In fact, a person can open the door 12 from the interior side 14 in substantially the same manner regardless of whether the door 12 is locked or unlocked, though a slightly greater rotational force may be required if the door 12 is locked since the deadbolt assembly 62 is also adjusted. This feature of the lock assembly 10, which allows the deadbolt assembly 62 to be unlocked using the same handle as that used for unlatching the door, is generally referred to as an anti-panic feature. According to one embodiment of the present invention, the anti-panic feature is installed so that a person can lock and unlock the door 12 from the exterior side 16 (i.e., using the key) and from the interior side 14 using the deadbolt handle 184. Further, when the assembly 10 is locked, a person at the interior side 14 of the door 12 can easily unlock and open the door 12 without the use of the deadbolt handle 184 by simply rotating the handle 24, e.g., in one direction to retract the deadbolt member 162 and in the other direction to retract the latch member 110. The anti-panic feature can substantially reduce the complexity of operation of the assembly 10, and facilitate the opening of the door 12 from the interior side 14, e.g., when a person wishes to quickly open the door 12 for exit therethrough.

When the deadbolt assembly 62 is locked, the rotation of the handle 26 from the exterior side 16 of the door 12 can also be prevented. In this regard, the catch plate 120 extends to the deadbolt assembly 62 and defines a flange 230 with a catch surface 232 configured to contact the link member 168 of the deadbolt assembly 62 when the deadbolt member 162 is in the extended position. That is, as shown in FIG. 6, when the link member 168 is adjusted toward the face member 36 and the deadbolt member 162 is extended, the link member 168 is disposed between the catch surface 232 of the catch plate 120 and the latch assembly 60, thereby preventing the catch plate 120 from moving toward the latch assembly 60. The catch plate 120 is engaged with the 100 of the latch link 68 so that, when the catch plate 120 is prevented from moving toward the latch assembly 60, the latch link 68 is prevented from rotating to retract the latch member 110. Thus, when the deadbolt assembly 62 is locked, the handle 26 on the exterior side 16 of the door 12 cannot be rotated to release the latch member 110, and the latch member 110 further secures the door 12 to the keeper structure 22.

It should be noted, however, that a small amount of rotation of the handle 24 at the interior side 14 of the door 12 is possible without moving the latch link 68 or the catch plate 120 so that the deadbolt assembly 62 can be unlocked as described above. For example, as shown in FIG. 7, when the first handle 24 is rotated clockwise, the handle 24 rotates through a limited range of motion before the tab 92 of the first plate 64 contacts the latch link 68. This rotation of the first plate 64 is sufficient to rotate the lock link 70 so that the driving feature 160 thereof contacts the arm 202 of the driver member 166 and actuates the deadbolt assembly 62 to retract the link member 168 sufficiently from the catch plate 120 so that catch plate 120 does not prevent further rotation of the handle 24.

The lock assembly 10, including the anti-panic feature thereof, can easily be reconfigured for an alternative installation. That is, in some cases, it may be desired to dispose the lock assembly 10 with the second side member 34 of the housing 30 directed toward the interior side 14 of the door 12 and the first side members 32, 34 directed toward the exterior side 16, with the second handle 26 being configured to unlock the deadbolt assembly 62. That is, with the anti-panic feature provided by the second handle 26 at the interior side 14 of the door 12. In that case, the installer can remove the lock screw 144 from the first plate 64 (if presently in the first plate 64) and screw the lock screw 144 into the second plate 66 so that the screw 144 extends through the second plate 66 and into the aperture 140 of the lock link 70, thereby connecting the second plate 66 and the lock link 70. In this configuration, the second plate 66 is configured to rotate the lock link 70 so that the deadbolt assembly 62 can be adjusted by a rotation of the second handle 26.

The side members 32, 34 of the housing 30 define access holes proximate the apertures in the first and second plates 64, 66 so that the lock screw 144 can be removed from either plate 64, 66 and disposed in either plate 64, 66 according to the desired configuration of the lock assembly 10 and without requiring disassembly of the housing 30 or an otherwise complex modification of the assembly.

The housing 30 also defines a threaded aperture 145 for receiving the lock screw 144. The threaded aperture 145 is illustrated as being provided in the second side member 34, but it is appreciated that the aperture 145 can be provided on either or both of the side members 32, 34. When the lock screw 144 is removed from the plates 64, 66 and disposed in the threaded aperture of the housing 30 (FIG. 10), neither of the plates 64, 66 is configured to rotate the lock link 70. Further, with the lock screw 144 in the threaded aperture, the lock screw 144 engages the lock link 70. In particular, the lock screw 144 extends through the housing 30 and extends into the mounting aperture 158 of the lock link 70. In this configuration, the post **42*b* is disposed at one end of the mounting aperture 158, and the lock screw 144 is disposed at the opposite end of the mounting aperture 158, such that rotation of the lock link 70 is substantially prevented. Thus, the lock link 70 is prevented from rotating to unlock the deadbolt assembly 62. In other embodiments, the lock screw 144 can instead extend through another aperture provided in the lock link 70, such as an aperture that corresponds to the cross-sectional size of the lock screw 144 so that the lock screw 144 prevents the lock link 70 from moving. Unlocking of the deadbolt assembly 62 can still be accomplished by rotating the key lock mechanism 182 with the deadbolt handle 184** or the key.

Thus, the lock assembly 10 is easily configurable in three different configurations. In the first configuration (FIG. 4), the lock assembly 10 is configured to be disposed in a door 12 with the first side member 32 disposed toward the interior side 14 of the door 12 so that the first handle 24 can be used to unlock the deadbolt assembly 62. In the second configuration (FIG. 9), the lock assembly 10 is configured to be disposed in a door 12 with the second side member 34 disposed toward the interior side 14 of the door 12 so that the second handle 26 can be used to unlock the deadbolt assembly 62. In the third configuration (FIG. 10), the lock assembly 10 is configured to prevent either handle 24, 26 from being used to unlock the deadbolt assembly 62 and, instead, the deadbolt assembly 62 can be unlocked only by adjusting the key lock mechanism 182 using the deadbolt handle 184 or the key.

As noted above, FIGS. 13-41 illustrate a lock assembly 10 according to another embodiment of the present invention, in which the catch plate 120 is configured to slide in direct contact against the face member 36. The embodiment of FIGS. 13-41 does not include the clamping slider 216 or the guide spacer 124. Otherwise, the configuration and operation of the lock assembly 10 is generally similar to the embodiment illustrated in FIGS. 1-12.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An anti-panic lock assembly for securing a door to a keeper structure mounted in a jamb of a door frame of the door such that the lock assembly can be selectively adjusted by a first handle extending from a first side of the door and a second handle extending from a second side of the door opposite the first side, the lock assembly comprising:

a housing configured to be disposed in the door;

first and second plates rotatably mounted in the housing, each of the plates being configured to be connected to a respective one of the handles such that the plates are configured to rotate about an axis defined by the handles;

a latch link configured to rotate about the axis, the latch link having a flange extending from the plates and defining a connection feature;

a latch member adjustably mounted in the housing and connected to the connection feature of the latch link such that the latch member is configured to be adjusted by a rotation of the latch link between an extended position and a retracted position to thereby selectively engage the keeper structure;

a lock link configured to rotate about the axis, the lock link having a flange extending from the plates and defining a driving feature; and a deadbolt assembly comprising:

a deadbolt member mounted in the housing and configured to be adjusted between an extended position and a retracted position to thereby selectively engage the keeper structure;

a link member slidably mounted in the housing and defining first and second connection features, the first connection feature structured to engage a key lock mechanism such that the link member is configured to be slidably adjusted by the key lock mechanism;

a driver member rotatably mounted in the housing and connected to the second connection feature of the link member and to the deadbolt member such that the driver member configured to be rotated by the link member and thereby adjust the deadbolt member between the extended and retracted positions;

wherein each of the plates and the lock link define a selective connection feature for selectively connecting each of the plates to the lock link to thereby configure the lock assembly in first and second configurations, the first plate being connected to the lock link in the first configuration such that a rotation of the first handle rotates the lock link with the driving feature of the lock link in contact with the deadbolt assembly to adjust the deadbolt assembly to an unlocked configuration, and the second plate being connected to the lock link in the second configuration such that a rotation of the second handle rotates the lock link with the driving feature of the lock link in contact with the deadbolt assembly to adjust the deadbolt assembly to an unlocked configuration.

2. An anti-panic lock assembly according to claim 1 wherein each of the plates and the lock link define an aperture for receiving a lock screw, the lock screw being configured to selectively connect a respective one of the plates to the lock link such that the lock link is configured to rotate with the respective plate and the lock link does not rotate with the other plate.

3. An anti-panic lock assembly according to claim 2 wherein the housing and the lock link define corresponding apertures for receiving the lock screw, such that the lock screw can be disposed to fix the lock link to the housing in a third configuration to thereby prevent a rotation of the lock link relative to the housing.

4. An anti-panic lock assembly according to claim 1 wherein the driving feature defined by the flange of the lock link is configured to contact the driver member and rotate the driver member when the lock link is rotated, such that a rotation of the lock link adjusts the deadbolt member to a retracted position.

5. An anti-panic lock assembly according to claim 1, further comprising a catch member adjustably mounted in the housing and configured to engage the deadbolt assembly with the latch assembly when the deadbolt assembly is adjusted to a locked configuration to prevent a rotation of the latch link by at least one of the plates and thereby prevent a retraction of the latch member.

6. An anti-panic lock assembly according to claim 1, further comprising:

a retainer member configured to slide against the housing in a direction perpendicular to a motion of the deadbolt member; and a deadbolt spring configured to bias the retainer member toward the driver member, wherein the retainer member defines a contoured cam profile configured to contact a cam shape of the driver member to guide the motion of the driver member, the retainer member and the driver member defining corresponding flats such that the retainer member is biased to at least one position.

7. An anti-panic lock assembly according to claim 6 wherein the deadbolt member defines a shoulder having a contoured profile for engaging the contoured cam profile defined by the retainer member, such that the contoured cam profile of the retainer member guides a motion of the shoulder and the deadbolt member as the deadbolt member is adjusted between the retracted and extended positions.

8. An anti-panic lock assembly for securing a door to a keeper structure mounted in a jamb of a door frame of the door such that the lock assembly can be selectively adjusted by a first handle extending from a first side of the door and a second handle extending from a second side of the door opposite the first side, the lock assembly comprising:

a latch assembly having a latch member configured to be adjusted by a rotation of the handles between an extended position and a retracted position to thereby selectively engage the keeper structure;

a deadbolt assembly having a deadbolt member configured to be adjusted by a rotation of a deadbolt handle and a key lock mechanism between an extended position and a retracted position to thereby selectively engage the keeper structure; and a selective connection feature configured to be selectively installed in first and second configurations to thereby selectively link the first and second handles to the deadbolt assembly, wherein in the first configuration the first handle is configured to adjust the deadbolt assembly to an unlocked configuration while the second handle is locked, and in the second configuration the second handle is configured to adjust the deadbolt assembly to an unlocked configuration while the first handle is locked, such that the lock assembly is configured to be installed to provide an anti-panic feature from a select side of the door.

9. An anti-panic lock assembly according to claim 8, further comprising:

first and second plates rotatable mounted in the housing, each of the plates being configured to be connected to a respective one of the handles such that the plates are configured to rotate about an axis defined by the handles, the plates being configured to rotate relate to each other through a limited range of rotation; and a latch link configured to rotate about the axis, the latch link having a flange extending from the plates and defining a connection feature for adjusting the latch assembly;

a lock link configured to rotate about the axis, the lock link having a flange extending from the plates and defining a driving feature for adjusting the deadbolt assembly, wherein each of the plates and the lock link define an aperture for receiving a lock screw, the lock screw being configured to selectively connect a respective one of the plates to the lock link such that the lock link is configured to rotate with the respective plate and the lock link does not rotate with the other plate.

10. An anti-panic lock assembly according to claim 9 wherein the lock link defines a aperture for receiving the lock screw to thereby fix the lock link in a third configuration and prevent a rotation of the lock link.

11. An anti-panic lock assembly according to claim 9 wherein the lock link is configured to contact a driver member of the deadbolt assembly and rotate the driver member when the lock link is rotated, such that a rotation of the lock link adjusts the deadbolt member to a retracted position.

12. An anti-panic lock assembly according to claim 8, further comprising a catch member adjustably mounted in the housing and configured to engage the deadbolt assembly with the latch assembly when the deadbolt assembly is adjusted to a locked configuration to prevent the latch member from being retracted by at least one of the handles.

13. An anti-panic lock assembly according to claim 8, further comprising:

a retainer member configured to be adjusted in a direction perpendicular to a motion of the deadbolt member; and a deadbolt spring configured to bias the retainer member toward the deadbolt assembly, wherein the retainer member defines a contoured cam profile configured to contact a cam shape defined by the deadbolt assembly to thereby guide the motion of the deadbolt assembly, the retainer member and the deadbolt assembly defining corresponding flats such that the retainer member is biased to at least one position.

14. An anti-panic lock assembly according to claim 13 wherein the deadbolt member defines a shoulder having a contoured profile for engaging the contoured cam profile defined by the retainer member, such that the contoured cam profile of the retainer member guides a motion of the shoulder and the deadbolt member as the deadbolt member is adjusted between the retracted and extended positions.

15. A method for providing an anti-panic lock assembly for securing a door to a keeper structure mounted in a jamb of a door frame of the door such that the lock assembly can be selectively adjusted by a first handle extending from a first side of the door and a second handle extending from a second side of the door opposite the first side, the method comprising:

providing a latch assembly having a latch member configured to be adjusted by a rotation of the handles between an extended position and a retracted position to thereby selectively engage the keeper structure;

providing a deadbolt assembly having a deadbolt member configured to be adjusted by a rotation of a deadbolt handle and a key lock mechanism between an extended position and a retracted position to thereby selectively engage the keeper structure; and selectively installing a selective connection feature in one of first and second configurations to thereby selectively link one of the first and second handles to the deadbolt assembly, wherein in the first configuration the first handle is configured to adjust the deadbolt assembly to an unlocked configuration while the second handle is locked, and in the second configuration the second handle is configured to adjust the deadbolt assembly to an unlocked configuration while the first handle is locked, such that the lock assembly is configured to be installed to provide an anti-panic feature from a select side of the door.

* * * * *